US006733006B2

(12) United States Patent
Kobayashi et al.

(10) Patent No.: US 6,733,006 B2
(45) Date of Patent: May 11, 2004

(54) SHEET POST-PROCESSING DEVICE AND IMAGE FORMING APPARATUS

(75) Inventors: Misao Kobayashi, Kofu (JP); Satoshi Iwama, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 10/386,420

(22) Filed: Mar. 13, 2003

(65) Prior Publication Data

US 2003/0173730 A1 Sep. 18, 2003

(30) Foreign Application Priority Data

Mar. 14, 2002 (JP) ..... 2002-069888

(51) Int. Cl.[7] ..... B65H 37/04

(52) U.S. Cl. ..... 270/37; 270/32; 270/58.08; 412/33; 412/18; 414/791.5; 399/410; 493/383

(58) Field of Search ..... 270/58.08, 58.11, 270/58.12, 58.14, 58.16, 32, 37; 493/383, 384, 405, 444; 412/33, 35, 18; 399/408, 410

(56) References Cited

U.S. PATENT DOCUMENTS 4,592,651 A * 6/1986 Oikawa et al. ..... 355/72
4,595,187 A * 6/1986 Bober ..... 270/37
4,891,681 A * 1/1990 Fiske et al. ..... 399/385
5,836,579 A * 11/1998 Hayashi et al. ..... 270/58.16
6,022,011 A * 2/2000 Hirose ..... 270/37
6,276,677 B1 * 8/2001 Hommochi et al. ..... 270/32
6,354,059 B1 * 3/2002 Yoshie et al. ..... 53/117
6,363,851 B1 * 4/2002 Gerhard et al. ..... 101/483
2003/0219294 A1 * 11/2003 Yoshimura et al. ..... 399/408
2003/0222391 A1 * 12/2003 Iwama ..... 271/1
2003/0223780 A1 * 12/2003 Kobayashi ..... 399/196

FOREIGN PATENT DOCUMENTS

JP 10194578 A * 7/1998 ..... B65H/37/06
JP 2000072320 A * 3/2000 ..... B65H/37/04
JP 2001302088 A * 10/2001 ..... B65H/45/18
JP 2003267622 A * 9/2003 ..... B65H/37/06

* cited by examiner

*Primary Examiner*—Patrick Mackey
(74) *Attorney, Agent, or Firm*—Kanesaka & Takeuchi

(57) ABSTRACT

A sheet post-processing device includes a placement unit for placing sheets discharged from an image forming apparatus, an offset unit for successively offsetting an edge of each sheet on the placement unit, and a saddle stitching unit for saddle stitching a stack of the sheets with the edge of each sheet shifted by the offset unit. The sheet post-processing device may include a folding unit for folding the stack of the sheets along a line where the sheets are stitched.

14 Claims, 20 Drawing Sheets

SHEET POST-PROCESSING DEVICE AND IMAGE FORMING APPARATUS

BACKGROUND OF THE INVENTION AND RELATED ART STATEMENT

The present invention relates to a sheet post-processing device and an image processing apparatus, and more particularly, relates to a sheet post-processing device for performing a folding operation and a saddle stitching operation on sheets discharged from an image forming apparatus, and an image forming apparatus equipped with the sheet post-processing device.

Japanese Patent Publication No. 2000-72320 has disclosed a sheet post-processing device (finisher). The sheet post-processing device performs a saddle stitching operation on a plurality of sheets having an image recorded thereon and discharged from an image forming apparatus. The sheet post-processing device also folds the sheets along a stitched portion thereof to bind a booklet. The sheet post-processing device performs the saddle stitching operation and the folding operation while edges of the sheets are aligned. The booklet is finished with the edges of the sheets neatly aligned.

As an increasing number of handicapped and aged people are involved in social and corporate activities, a variety of efforts are made to provide an environment suitable for the handicapped and aged people in corporate offices, government offices and the likes.

However, the booklets bound by such a conventional sheet post-processing device are typically aligned at the edges thereof. Accordingly, while the booklets with the page edges neatly aligned look good, it is difficult to turn pages for people who are forced to use a single hand.

It is an object of the present invention to provide a sheet post-processing device for binding a booklet that is easy to turn pages, and an image forming apparatus equipped with such a sheet post-processing device.

Further objects and advantages of the invention will be apparent from the following description of the invention.

SUMMARY OF THE INVENTION

In the first aspect of the present invention, a sheet post-processing device includes a placement unit for placing sheets discharged from an image forming apparatus, an offset unit for successively offsetting an edge of each sheet on the placement unit, and a folding unit for folding a stack of the sheets with the edge of each sheet offset by the offset unit.

According to the first aspect of the present invention, the sheets discharged from the image forming apparatus are stacked on the placement unit with the edge of each sheet successively offset by the offset unit. The folding unit performs a folding operation on the stack of the sheets with the edge of each sheet offset. Since the folding unit performs the folding operation on the sheet stack in a state that the offset unit offsets the edge of each sheet successively, the pages of the sheet stack are easy to turn.

In the second aspect of the present invention, a sheet post-processing device includes a placement unit for placing sheets discharged from an image forming apparatus, an offset unit for successively offsetting an edge of each sheet on the placement unit, and a saddle stitching unit for saddle stitching a stack of the sheets with the edge of each sheet offset by the offset unit.

According to the second aspect of the present invention, the sheets discharged from the image forming apparatus are stacked on the placement unit with the edge of each sheet successively offset by the offset unit. The saddle stitching unit performs a saddle stitching operation on the sheet stack with the edge of each sheet offset. The saddle stitching unit performs the saddle stitching operation on the sheet stack in the state that the edge of each sheet is successively offset by the offset unit. Therefore, when the saddle stitched sheet stack is folded, the pages of the resulting booklet are easy to turn.

In the third aspect of the present invention, a sheet post-processing device includes a placement unit for placing sheets discharged from an image forming apparatus, an offset unit for successively offsetting an edge of each sheet on the placement unit, a saddle stitching unit for performing a saddle stitching operation on a stack of the sheets with the edge of each sheet offset by the offset unit, and a folding unit for performing a folding operation on a predetermined position of the stack of the sheets saddle stitched by the saddle stitching unit.

According to the third aspect of the present invention, the offset unit successively offsets the edge of each of the sheets discharged from the image forming apparatus, and the sheets are stacked on the placement unit. Then, the saddle stitching unit performs a saddle stitching operation on the sheet stack in the state that the offset unit successively offsets the edge of each sheet. The folding unit performs a folding operation on the predetermined position of the stack of the sheets saddle stitched by the saddle stitching unit. In the third aspect, the saddle stitching unit performs the saddle stitching operation on the sheet stack in the state that the offset unit offsets the edge of each sheet successively, and the folding unit performs the folding operation at the predetermined position of the stack of the sheets saddle stitched by the saddle stitching unit, thereby making it easy to turn pages of the booklet.

According to the first through third aspects, the offset unit preferably offsets the sheets stacked on the placement unit so that an edge portion of each sheet remains visible when viewed from above or from below the sheet. In this arrangement, all edges of the sheets are shifted with each other, and the pages of the sheet stack or the booklet are easy to turn. According to the second and third aspects, the saddle stitching unit preferably performs the saddle stitching operation on a position of the sheets closer to one edge opposite to the other edge. In this arrangement, the sheet stack is folded or is subjected to the folding operation, and the edges of all pages are offset with each other, thereby making it easy to turn the pages. In the first and third aspect, the folding unit preferably performs the folding operation so that an edge of the innermost sheet remains visible after the stack of the sheets is folded. Therefore, all pages of the sheet stack or booklet subsequent to the folding operation have the edges shifted with each other, thereby making it further easy to turn the pages. In the third aspect, the folding unit preferably performs the folding operation on the saddle stitched stack sheets at a saddle stitching position as a folding position.

In the fourth aspect of the present invention, a sheet post-processing device includes a placement unit for placing sheets discharged from an image forming apparatus; a restraining unit movable between a restraining position at which the restraining unit restrains and aligns edges of the sheets discharged into the placement unit and a retraction position to which the restraining unit is retracted from the restraining position thereof; an urging unit for urging the sheets discharged into the placement unit toward the restraining unit; a sheet moving unit movable between the first position at which the sheet moving unit moves all the sheets by a predetermined distance with all the sheets on the placement unit nipped and the second position at which the sheet moving unit is away from the sheets on the placement unit and allows the urging unit to urge the sheets; a folding unit for performing a folding operation on the sheets; and a control unit for controlling the restraining unit to move to the retraction position from the restraining position after restraining and aligning the edge of the sheet discharged into the placement unit, and for controlling the sheet moving unit to move all the sheets on the placement unit by the predetermined distance. Then, the control unit controls the urging unit to urge the sheets toward the restraining unit for alignment while the restraining unit and sheet moving unit move to the restraining position and the second position, respectively. The control unit repeats the above steps until a stack of the sheets with the edge of each sheet offset with each other is formed on the placement unit, and then controls the folding unit to perform the folding operation on the stack of the sheets.

In the fourth aspect of the present invention, with the control unit, the restraining unit moves to the retraction position from the restraining position after restraining and aligning the edges of the preceding sheets discharged into the placement unit. After the sheet moving unit at the first position thereof moves all the sheets on the placement unit by the predetermined distance, the restraining unit and sheet moving unit move to the restraining position and the second position, respectively. Under this state, the urging unit urges the subsequent sheets toward the restraining unit for alignment. The control unit repeats this series of operations, thereby forming the stack of the sheets with the edge of each sheet successively offset. The control unit controls the folding unit to perform the folding operation on the stack of the sheets. As a result, the folding operation is performed in the state that each sheet is offset with each other, thereby making it easy to turn the pages.

In the fifth aspect of the present invention, a sheet post-processing device includes a placement unit for placing sheets discharged from an image forming apparatus; a restraining unit movable between a restraining position at which the restraining unit restrains and aligns edges of the sheets discharged into the placement unit and a retraction position to which the restraining unit is retracted from the restraining position thereof; an urging unit for urging the sheets discharged into the placement unit toward the restraining unit; a sheet moving unit movable between the first position at which the sheet moving unit moves all the sheets by a predetermined distance with all the sheets on the placement unit nipped and the second position at which the sheet moving unit is away from the sheets on the placement unit and allows the urging unit to urge the sheets; a saddle stitching unit for performing a saddle stitching operation on the sheets; and a control unit for controlling the restraining unit to move to the retraction position from the restraining position after restraining and aligning the edges of the sheets discharged into the placement unit, and for controlling the sheet moving unit to move all the sheets on the placement unit by the predetermined distance. Then, the control unit controls the urging unit to urge the sheets toward the restraining unit for alignment while the restraining unit and sheet moving unit moved to the restraining position and the second position, respectively. The control unit repeats the above steps until a stack of the sheets with the edge of each sheet successively offset with each other is formed on the placement unit, and then controls the saddle stitching unit to perform the saddle stitching operation on the stack of the sheets. In the fifth aspect of the present invention, the stitching operation is performed in the state that the edge of each sheet is offset with each other. The sheet stack is folded after the saddle stitching operation, thereby making it easy to turn the pages.

In the sixth aspect of the present invention, a sheet post-processing device includes a placement unit for placing sheets discharged from an image forming apparatus; a restraining unit movable between a restraining position at which the restraining unit restrains and aligns edges of the sheets discharged into the placement unit and a retraction position to which the restraining unit is retracted from the restraining position thereof; an urging unit for urging the sheets discharged into the placement unit toward the restraining unit; a sheet moving unit movable between the first position at which the sheet moving unit moves all the sheets by a predetermined distance with all the sheets on the placement unit nipped and the second position at which the sheet moving unit is away from the sheets on the placement unit and allows the urging unit to urge the sheets; a saddle stitching unit for performing a saddle stitching operation on the sheets; and a control unit for controlling the restraining unit to move to the retraction position from the restraining position after restraining and aligning the edges of the sheets discharged into the placement unit, and for controlling the sheet moving unit to move all the sheets on the placement unit by the predetermined distance. Then, the control unit controls the urging unit to urge the sheets toward the restraining unit for alignment while the restraining unit and sheet moving unit moved to the restraining position and the second position, respectively. The control unit repeats the above steps until a stack of the sheets with the edge of each sheet successively offset with each other is formed on the placement unit. Then, the control unit controls the saddle stitching unit to perform the saddle stitching operation, and then controls the folding unit to perform the folding operation at the saddle stitched portion of the stack of the sheets saddle stitched by the saddle stitching unit. In the sixth aspect of the present invention, the stitching operation is performed with the edge of each sheet successively offset with each other, and the folding operation is performed on the sheet stack at the saddle stitch portion subsequent to the saddle stitching operation, thereby making it easy to turn the pages.

In the fourth through sixth aspects, the control unit preferably controls the restraining unit to hold all the sheets on the placement unit at the restraining position when the urging unit urges the subsequent sheets toward the restraining unit. When the urging unit urges the subsequent sheets toward the restraining position, the sheet moving unit is at the second position to allow the urging unit to urge the sheets, and all the sheets are free (not in a held state) on the placement unit. If the subsequent sheets are urged, a posture of the sheets with the edge of each sheet offset is destroyed. Therefore, the restraining unit holds all the sheets on the placement unit, so that the offset position of the sheets remains unchanged. Since the restraining unit holds the sheets without extra means for holding the sheets, it is possible to make the apparatus small. The sheet post-processing device may further include a setting unit for setting and adjusting a distance of travel of all the sheets to be moved by the sheet moving unit on the placement unit. The control unit controls the sheet moving unit in accordance with the distance of travel set and adjusted by the setting unit. With this configuration, the distance of travel, namely, the shift of each sheet is set and adjusted. Therefore, it is easy to turn the pages of the resulting booklet even for a person with large fingers, a person with a handicap in a hand, or a person with a difficulty in controlling shaking fingers.

In the seventh aspect of the present invention, an image forming apparatus includes a storage unit for storing sheets; a sheet feeder unit for feeding the sheets from the storage unit one by one; an image forming unit for forming an image on the sheet fed by the sheet feeder unit; a placement unit for placing the sheets with the image thereon discharged from the image forming unit; a restraining unit movable between a restraining position at which the restraining unit restrains and aligns edges of the sheets discharged into the placement unit and a retraction position to which the restraining unit is retracted from the restraining position thereof; an urging unit for urging the sheets discharged into the placement unit toward the restraining unit; a sheet moving unit movable between the first position at which the sheet moving unit moves all the sheets by a predetermined distance with all the sheets on the placement unit nipped and the second position at which the sheet moving unit is away from the sheets on the placement unit and allows the urging unit to urge the sheets; a folding unit for performing a folding operation on the sheets; and a control unit for controlling the restraining unit to move to the retraction position from the restraining position after restraining and aligning the edge of the sheet discharged into the placement unit, and for controlling the sheet moving unit to move all the sheets on the placement unit by the predetermined distance. Then, the control unit controls the urging unit to urge the sheets toward the restraining unit for alignment while the restraining unit and sheet moving unit move to the restraining position and the second position, respectively. The control unit repeats the above steps until a stack of the sheets with the edge of each sheet offset with each other is formed on the placement unit, and then controls the folding unit to perform the folding operation on the stack of the sheets.

In the eighth aspect of the present invention, an image forming apparatus includes a storage unit for storing sheets; a sheet feeder unit for feeding the sheets from the storage unit one by one; an image forming unit for forming an image on the sheet fed by the sheet feeder unit; a placement unit for placing the sheets with the image thereon discharged from the image forming unit; a restraining unit movable between a restraining position at which the restraining unit restrains and aligns edges of the sheets discharged into the placement unit and a retraction position to which the restraining unit is retracted from the restraining position thereof; an urging unit for urging the sheets discharged into the placement unit toward the restraining unit; a sheet moving unit movable between the first position at which the sheet moving unit moves all the sheets by a predetermined distance with all the sheets on the placement unit nipped and the second position at which the sheet moving unit is away from the sheets on the placement unit and allows the urging unit to urge the sheets; a saddle stitching unit for performing a saddle stitching operation on the sheets; and a control unit for controlling the restraining unit to move to the retraction position from the restraining position after restraining and aligning the edges of the sheets discharged into the placement unit, and for controlling the sheet moving unit to move all the sheets on the placement unit by the predetermined distance. Then, the control unit controls the urging unit to urge the sheets toward the restraining unit for alignment while the restraining unit and sheet moving unit moved to the restraining position and the second position, respectively. The control unit repeats the above steps until a stack of the sheets with the edge of each sheet successively offset with each other is formed on the placement unit, and then controls the saddle stitching unit to perform the saddle stitching operation on the stack of the sheets. In the fifth aspect of the present invention, the stitching operation is performed in the state that the edge of each sheet is offset with each other. The sheet stack is folded after the saddle stitching operation, thereby making it easy to turn the pages.

In the ninth aspect of the present invention, an image forming apparatus includes a storage unit for storing sheets; a sheet feeder unit for feeding the sheets from the storage unit one by one; an image forming unit for forming an image on the sheet fed by the sheet feeder unit; a placement unit for placing the sheets with the image thereon discharged from the image forming unit; a restraining unit movable between a restraining position at which the restraining unit restrains and aligns edges of the sheets discharged into the placement unit and a retraction position to which the restraining unit is retracted from the restraining position thereof; an urging unit for urging the sheets discharged into the placement unit toward the restraining unit; a sheet moving unit movable between the first position at which the sheet moving unit moves all the sheets by a predetermined distance with all the sheets on the placement unit nipped and the second position at which the sheet moving unit is away from the sheets on the placement unit and allows the urging unit to urge the sheets; a saddle stitching unit for performing a saddle stitching operation on the sheets; and a control unit for controlling the restraining unit to move to the retraction position from the restraining position after restraining and aligning the edges of the sheets discharged into the placement unit, and for controlling the sheet moving unit to move all the sheets on the placement unit by the predetermined distance. Then, the control unit controls the urging unit to urge the sheets toward the restraining unit for alignment while the restraining unit and sheet moving unit moved to the restraining position and the second position, respectively. The control unit repeats the above steps until a stack of the sheets with the edge of each sheet successively offset with each other is formed on the placement unit. Then, the control unit controls the saddle stitching unit to perform the saddle stitching operation, and then controls the folding unit to perform the folding operation at the saddle stitched portion of the stack of the sheets saddle stitched by the saddle stitching unit.

BRIEF DESCRIPTION OF THE DRAWINGS

FIGS. 12(A) and 12(B) are views showing the folding unit in a saddle staple mode, wherein FIG. 12(A) is a side view showing a state prior to a sheet stack folding operation, and FIG. 12(B) is a side view showing a state during the sheet stack folding operation;

FIGS. 17(A) and 17(B) are views showing the folding unit in a saddle stitch mode and an offset saddle mode, wherein FIG. 17(A) is a side view showing a state prior to the sheet stack folding operation, and FIG. 17(B) is a side view showing a state during the sheet stack folding operation;

DETAILED DESCRIPTION OF PREFERRED EMBODIMENTS

Hereunder, embodiments of the present invention will be explained with reference to the accompanying drawings.

Figure 1:
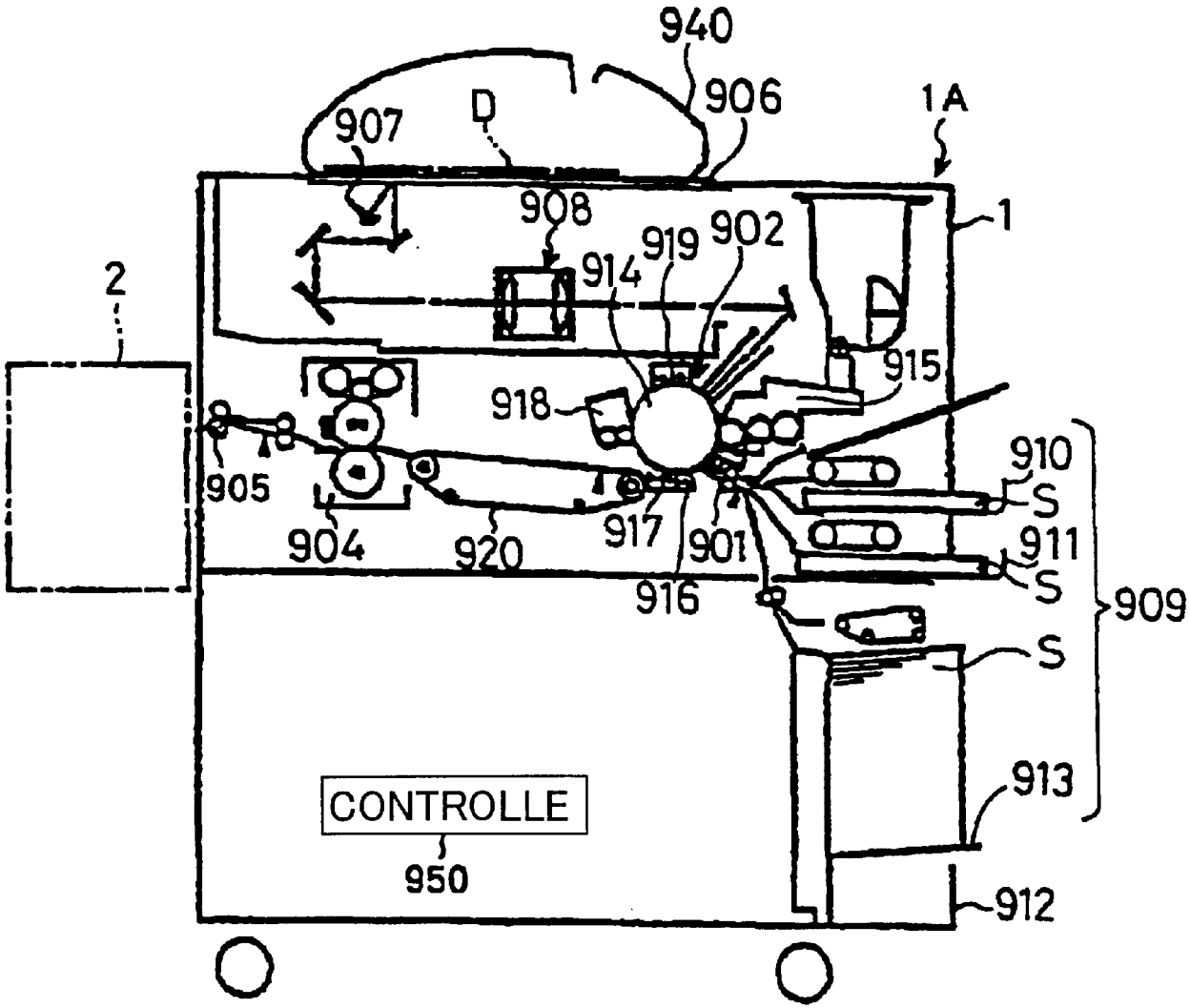
FIG. 1 is a side view of a copier to which the present invention is applicable.

As shown in FIG. 1, a copying apparatus 1A of the present invention includes a copying apparatus main unit 1 for forming an image on a sheet, and a sheet post-processing device 2 detachably mounted on the copying apparatus main unit 1 for performing a saddle stitching operation and a folding operation on the sheets discharged from the copying apparatus main unit 1.

The copying apparatus main unit 1 includes an image forming assembly 902 for recording an image of an original document D on a sheet; an optical system 908 disposed above the image forming assembly 902 for focusing light reflected from the original document D on the image forming assembly 902, and having a light source 907 for emitting light toward the original document D; a sheet feeder 909 disposed at a side opposite to the sheet post-processing device 2 for feeding the sheets S one by one to the image forming assembly 902; and a control unit 950 for controlling all these components.

The sheet feeder 909 includes cassettes 910 and 911 detachably mounted on the copying apparatus main unit 1 for stacking and holding sheets S on which the images are to be formed (recorded); a large-capacity tray unit (LCT) fixed on a base (pedestal) 912 at a bottom of the copying apparatus main unit 1 for stacking a large number of the sheets S, and having a deck 913; and a manual feeder plate obliquely arranged above the cassette 910 for feeding the sheet manually. A pair of register rollers 901 for correcting a skew of the sheet S fed from the sheet feeder 909 is arranged at downstream of the sheet feeder 909 and near upstream of a photoconductive drum 914 (describe later).

The image forming assembly 902 includes the cylindrical photoconductive drum 914 for forming an electrostatic latent image on a circumference thereof. Around the photoconductive drum 914 are arranged a primary charging unit 919 for charging the photoconductive drum 914 for the latent image formation; a development unit 915 for developing the electrostatic latent image formed on the photoconductive drum 914 into a toner image; a transfer unit 916 for transferring the toner image onto the sheet S; a separating charging unit 917 for separating the sheet S from the photoconductive drum 914 by charging the sheet S in a polarity opposite to the transfer unit 916; and a cleaner 918 for cleaning the photoconductive drum 914.

A roller around which an endless conveyance belt 920 is wound is arranged at downstream of the photoconductive drum 914 and near the separating charging unit 917. The endless conveyance belt 920 is entrained to a roller arranged near a fixing unit 904 including a heater roller for heating and fixing the toner image onto the sheet S. A pair of discharge rollers 905 is arranged at downstream of the fixing unit 904 for discharging the sheet S with the image thereon from the copying apparatus main unit 1.

A platen glass 906 for placing the document D thereon and an operation unit (not shown) for receiving commands from an operator are disposed at an upper portion of the copying apparatus main unit 1. An automatic document feeder (ADF) 940 is arranged on and covers the platen glass 906. One side of the automatic feeder 940 is attached to the top of the copying apparatus main unit 1, and the other side thereof is pivotally supported on the copying apparatus main unit 1. The automatic document feeder 940 automatically feeds the document D to the platen glass 906.

Figure 2:
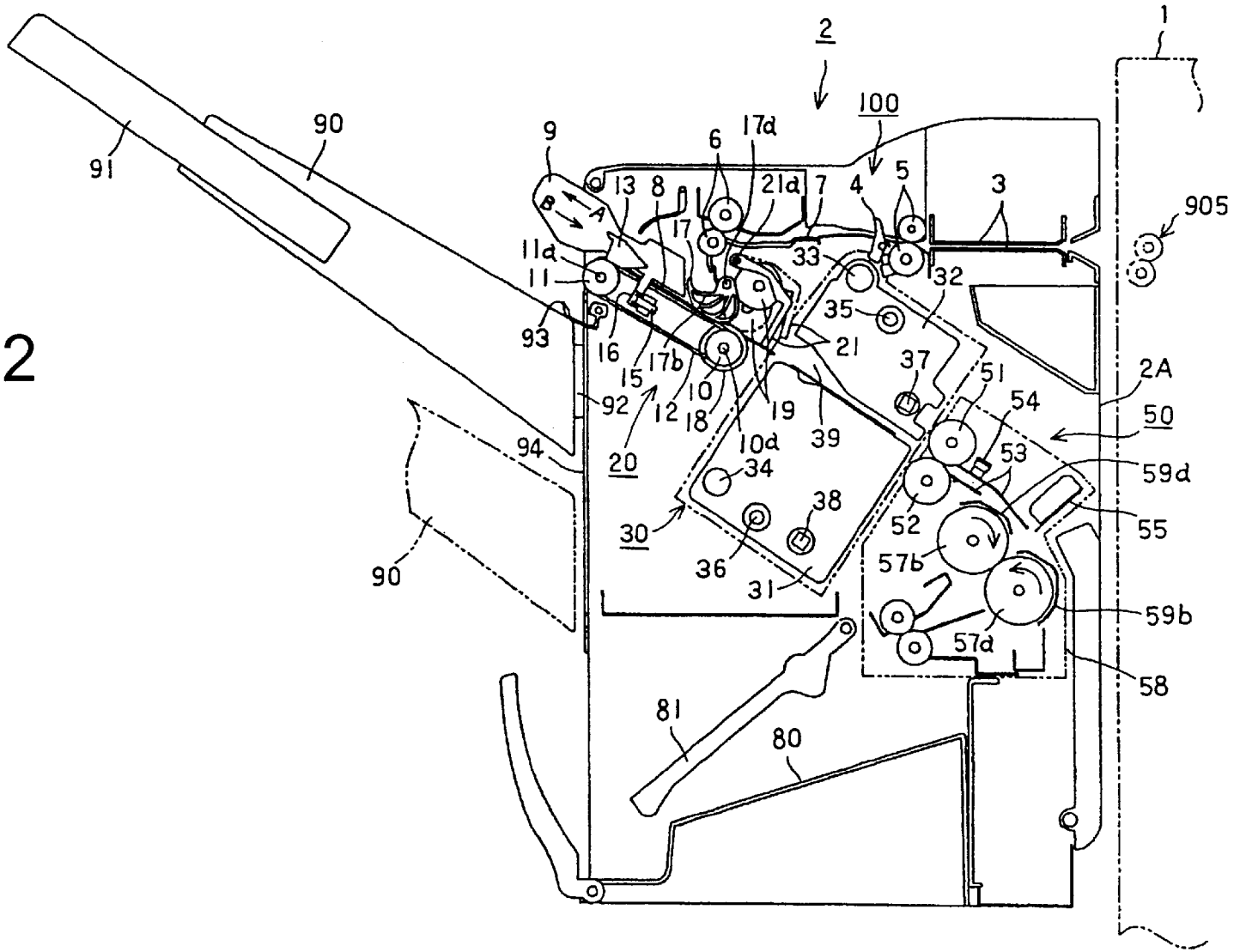
FIG. 2 is a side view of a sheet post-processing device.

As shown in FIG. 2, in a device frame 2A as a casing of the sheet post-processing device 2, the sheet post-processing device 2 includes a conveyance unit 100 for conveying the sheet S discharged from the copying apparatus main unit 1 to a side opposite to the discharge roller pair 905 in a substantially horizontal direction; an offset unit 20 obliquely arranged below the conveyance unit 100 for offsetting the edge of the sheet S; a stapler unit 30 arranged at downstream of the offset unit 20 for performing a stitching process on a stack of the sheets S; a folding unit 50 obliquely arranged at downstream of the stapler unit 30 for performing a folding process on a predetermined folding position of the sheet stack; a stack unit for collecting the sheets S or booklets; and a control unit for controlling these units in the sheet post-processing device 2.

The conveyance unit 100 includes a conveyance guide 3 for receiving the sheets S successively discharged from the copying apparatus main unit 1 and for guiding the sheets S into the sheet post-processing device 2; a conveyance path guide 7 arranged at downstream of the conveyance guide 3 for guiding the sheet S further downstream; a pair of conveyance rollers 5 arranged between the conveyance guide 3 and the conveyance path guide 7 for conveying the sheet S through a nip thereof; a sheet detector sensor 4 arranged near downstream position of the conveyance rollers 5 for detecting the sheet S brought into the conveyance path guide 7 and jamming of the sheet S in the conveyance unit 100; and a pair of discharge rollers 6 arranged at the most downstream position of the conveyance path guide 7 for discharging the sheet S through a nip thereof.

As shown in FIG. 2, the offset unit 20 includes a process tray 8 for collecting the sheets S discharged through the pair of the discharge rollers 6. The process tray 8 is arranged at an angle of about 30 degrees with respect to a placement surface of the copying apparatus main unit 1 with facing downward in the direction of sheet conveyance for assisting the offset unit 20 to convey the sheet S. The process tray 8 has an alignment plate 9 for guiding both sides of the sheet S for alignment in a width direction.

Figure 3:
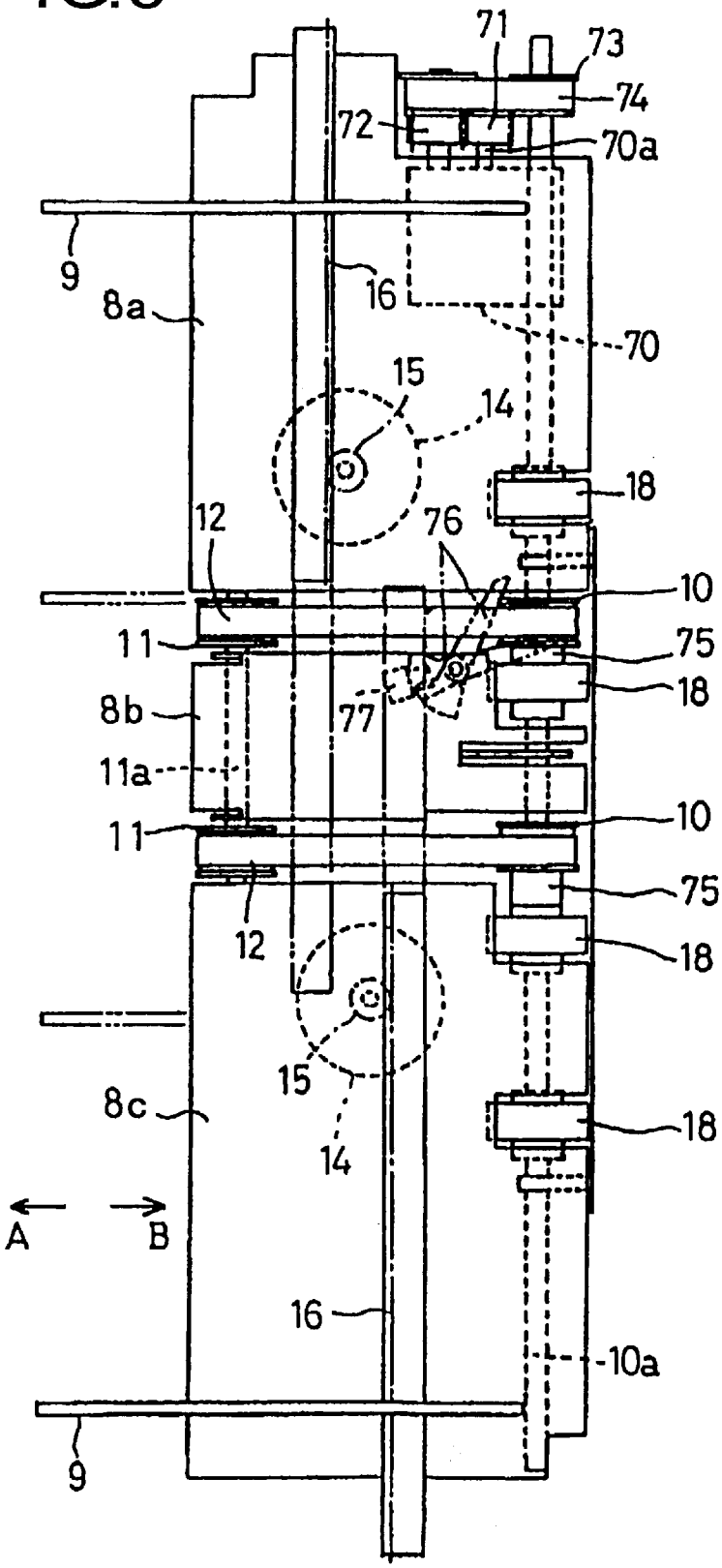
FIG. 3 is a plan view of a process tray of the sheet post-processing device.

As shown in FIG. 3, the process tray 8 has a rectangular shape elongated in a width direction substantially perpendicular to the sheet conveyance direction (the arrow direction B). The process tray 8 is divided into three parts, namely, a left tray 8*c* for supporting a left portion (top portion in FIG. 3) of the sheet S advancing in the sheet conveyance direction, a center tray 8*b* for supporting a center portion of the sheet S, and a right tray 8*a* for supporting a right portion of the sheet S (bottom portion in FIG. 3).

Alignment motors 14 formed of stepping motors capable of rotating in both directions are arranged near the center tray 8*b* on lower portions of the left tray 8*c* and right tray 8*a*, respectively. Each of the alignment motors 14 has a pinion 15 fixed to the motor shaft thereof. The pinions 15 engage racks 16 having substantially the same lengths as widths of the left tray 8*c* and right tray 8*a*. An elongated rectangular fixing member is extended from the lower portion of each of the alignment plates 9. The fixing members pass through slits extending in the width directions of the left tray 8*c* and right tray 8*a*, and ends of the fixing members are secured to the respective racks 16 (see also FIG. 2). Accordingly, the alignment plates 9 are movable in the width direction of the right tray 8*a* and left tray 8*c* as the alignment motors 14 rotate.

A stepping motor 70 capable of rotating in both directions is arranged on a side of and below the right tray 8*a* (on a side of the stapler unit 30). The stepping motor 70 has a gear 71 fixed to a motor shaft 70*a* thereof. The gear 71 engages a gear portion of a gear pulley 72 supported by a fixed arm extending from the stepping motor 70. A timing belt 74 is entrained between a pulley portion of the gear pulley 72 and a pulley 73. The pulley 73 is secured to the first pulley shaft 10*a* rotatably supported on one side of the process tray 8 and having substantially the same length as the width of the process tray 8. The second pulley shaft 11*a*, shorter than the first pulley shaft 10*a*, is supported at a position opposite to the first pulley shaft 10*a* below the center tray 8*b* (on the other side of the center tray 8*b*).

The first pulley shaft 10*a* has four conveyance lower rollers 18 rigidly attached thereto, i.e. two rollers on the right side and the two rollers on the left side of the substantial center of the sheet advancing in the sheet conveyance direction (i.e., two rollers on the upper side and the two rollers on the lower side in FIG. 3). The conveyance lower rollers 18 have a hollow shape like a tire. A circumference of each conveyance lower roller 18 is exposed above a top surface of the process tray 8 through a cutout formed in one side of the process tray 8 (see also FIG. 4).

The first pulleys 10 with a smaller diameter than that of the conveyance lower rollers 18 are fixed to the first pulley shaft 10*a* via a one-way clutch 75 for transmitting drive only in the counterclockwise direction. Also, the second pulleys 11 with the same diameter as the first pulley 10 are fixed to the second pulley shaft 11*a*. The first pulley 10 and second pulley 11 are arranged between the center tray 8*b* and the right tray 8*a*, and the other first pulley 10 and the other second pulley 11 are arranged between the center tray 8*b* and left tray 8*c*. Two endless conveyance belts 12 are entrained between the first pulleys 10 and second pulleys 11. The rotation of the stepping motor 70 transferred to the first pulley shaft 10*a* through the one-way clutch 75 is transferred to the second pulley 11 only when the first pulleys 10 rotate counterclockwise, in other words, only when the conveyance belts 12 move in the arrow direction A. When the first pulley shaft 10*a* rotates clockwise (when the conveyance belts 12 moves in the arrow direction B in FIG. 3), the rotation is not transferred to the second pulleys 11.

As shown in FIG. 2, a paddle 17 is disposed below the conveyance path guide 7 and above the process tray 8. The paddle 17 rotates around an axis 17*a*, thereby urging the sheet S in the sheet conveyance direction. The paddle 17 is formed of an elastic material such as a rubber having a certain elasticity, and includes integrally formed fins 17*b* radially extending from the axis 17*a* as the center thereof. As the sheets S are discharged and stacked on the process tray 8, the paddle 17 is easily deformed, thereby providing an appropriate urging force to the sheets S in the sheet conveyance direction.

Figure 4:
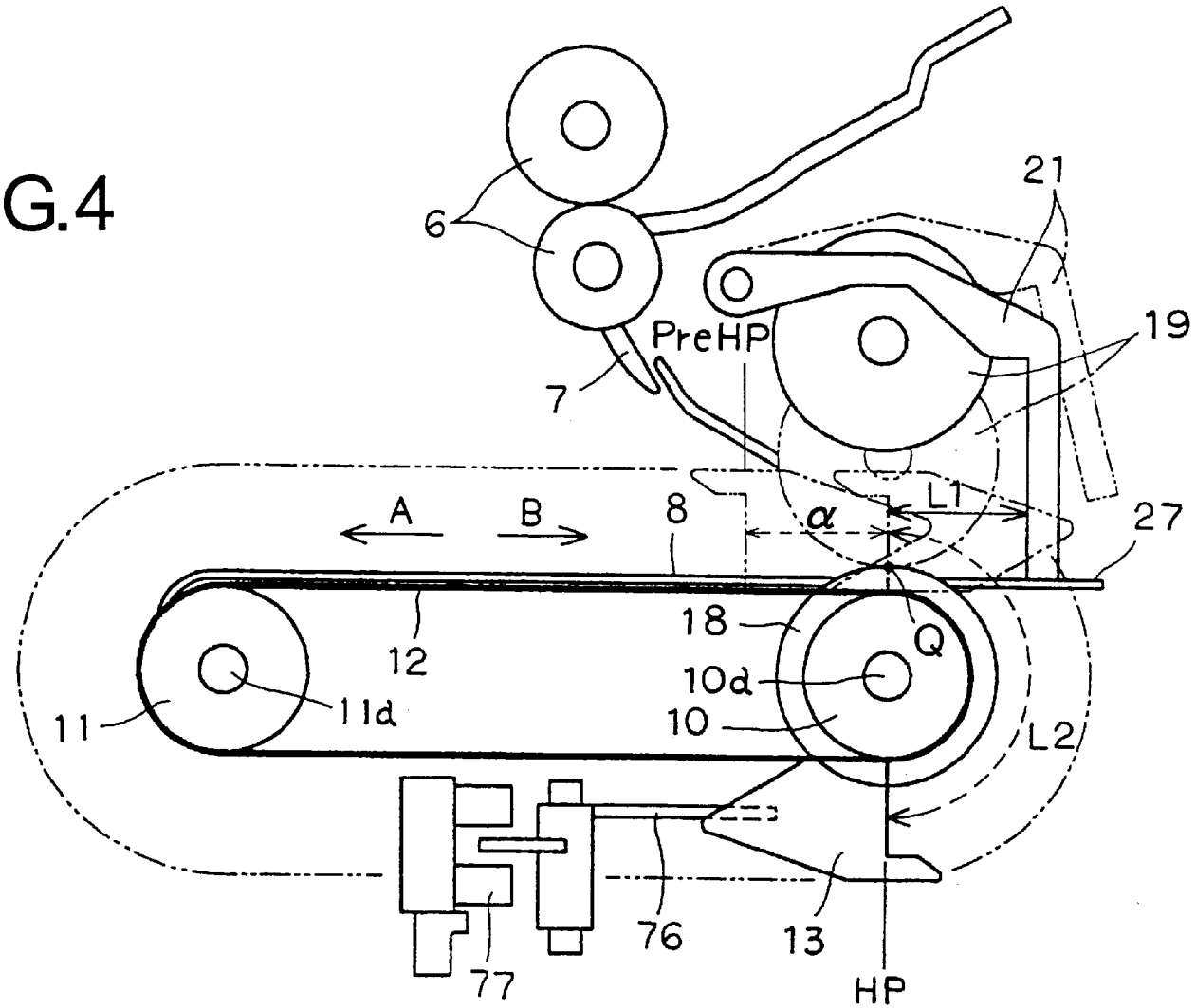
FIG. 4 is a side view of a conveyance belt of the process tray of the sheet post-processing device.

As shown in FIG. 4, a pushing nail 13 is fixed to the conveyance belt 12. An edge of the pushing nail 13 abuts against a sheet stack of the sheets S collected on the process tray 8, and pushes the sheet stack in the arrow direction A. The pushing nail 13 has a home position (also referred to as HP position) where the edge of the pushing nail 13 is located right below the first pulley shaft 10*a*. A detector arm 76 engaging the pushing nail 13 and an arm detector sensor 77 formed of an integrated transmission type sensor are arranged below the conveyance belt 12 to detect the HP position of the pushing nail 13 (see also FIG. 3).

A conveyance upper roller 19 is arranged above each conveyance lower roller 18. The conveyance upper roller 19 moves between a contact position (the first position) where the conveyance upper roller 19 contacts the conveyance lower roller 18 at a contact point (nip) Q as represented by a phantom line in FIG. 4, and a spaced position (the second position) where the conveyance upper roller 19 is away from the conveyance lower roller 18. The conveyance upper roller 19 moves between the contact position and the spaced position through a cam and the likes (not shown). Also, the stepping motor 70 (see FIG. 11) rotates the conveyance upper roller 19 through gears (not shown).

A first stack guide 27 is arranged in the same tilted plane of the process tray 8 at downstream of the process tray 8 to support (hold) the sheet stack in cooperation with the process tray 8. A stopper 21 is arranged above the first stack guide 27. The stopper 21 restrains and aligns edges of the sheets S while the sheets fall by their own weight onto the tilted process tray 8 and first stack guide 27 in the sheet conveyance direction and are urged by the rotation of the paddle 17.

Figure 5:
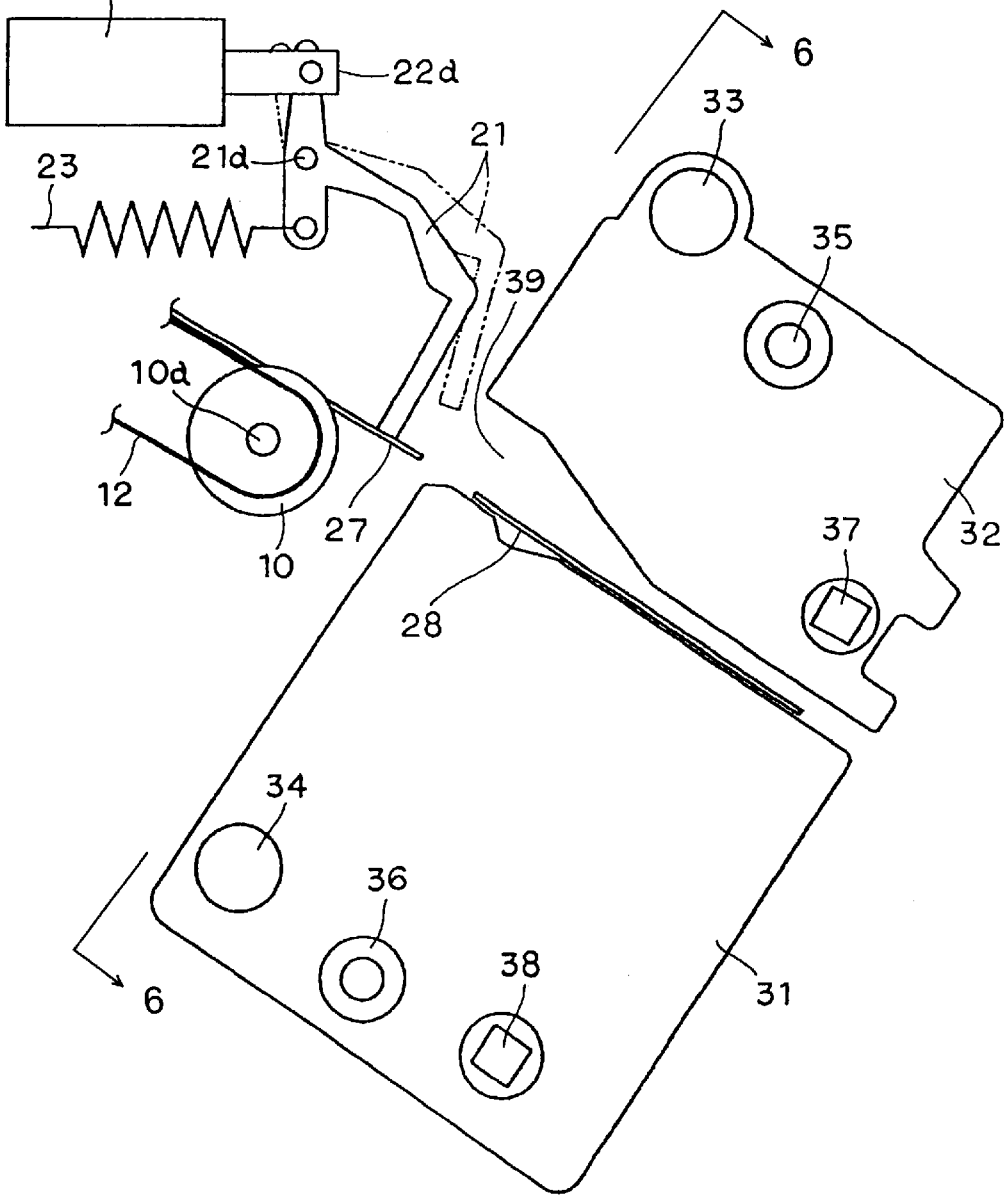
FIG. 5 is a side view of a stopper of the sheet post-processing device.

As shown in FIG. 5, the stopper 21 has a J-shaped cross section with an arm and a leg. One end of the arm of the stopper 21 is connected to a plunger 22*a* of a solenoid 22, and the other end of the arm is pulled by a spring 23 with a predetermined force. In response to on and off operations of the solenoid 22, the stopper 21 pivotally moves around a support shaft 21*a* located at the approximate center of the arm thereof between a restraining position where a bottom surface of the leg (end of the leg) abuts against the top surface of the first stack guide 27 as represented by a solid line and a retraction position where the stopper 21 is retracted from the top surface of the first stack guide 27 as represented by a phantom line. The stopper 21 normally stays at the retraction position (in the off state of the solenoid 22) as represented by the solid line.

The pushing nail 13 remains movable in the arrow direction A shown in FIG. 4 in a normal state when the conveyance upper roller 19 is in the spaced position and the stopper 21 is in the retraction position. When an end of the pushing nail 13 is positioned at the contact point Q between the conveyance lower roller 18 and the conveyance upper roller 19, L1 represents a distance from the end of the pushing nail 13 to the stopper 21. Also, L2 represent a distance from the contact point Q to the end of the pushing nail 13 when the pushing nail is located at the HP position. It is configured such that L2 is greater than L1. As shown in FIG. 4, a lower end of the conveyance path guide 7 extending below the discharge roller pair 6 engages a fixed guide pressing the sheet S discharged into the process tray 8 to prevent the edge of the sheet S from sticking above the conveyance upper roller 19.

As shown in FIGS. 2 and 5, the stapler unit 30 is arranged at downstream of the offset unit 20, and includes a head assembly 31 and an anvil assembly 32. The head assembly 31 has a staple cartridge below a conveyance path 39 of the sheet to drive a staple. The anvil assembly 32 is located above the conveyance path, and receives and folds tips of the staple driven from the head assembly 31. The second stack guide 28 is arranged in the conveyance path 39 away from a staple driving head of the head assembly 31 and above the head assembly 31, and has the same tilted plane as the first stack guide 27. The stapler unit 30 is constructed in an unit as represented by a phantom line in FIG. 2, and can be drawn out for replenishing staples.

Figure 6:
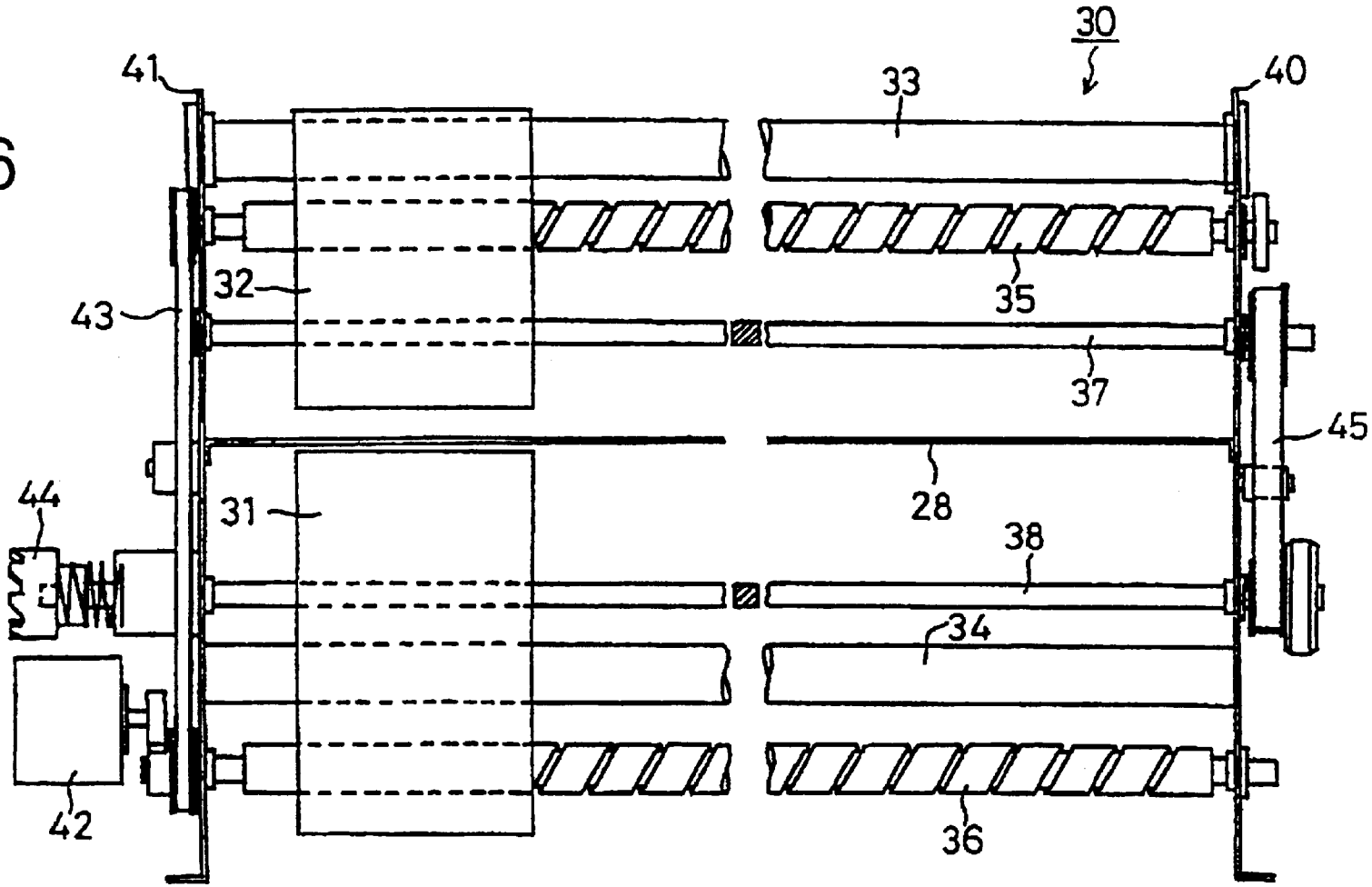
FIG. 6 is a front view of a stapler unit of the sheet post-processing device viewed from line 6—6 in FIG. 5.

As shown in FIG. 6, between left and right unit frames 40 and 41, the stapler unit 30 includes cylindrical guide rods 33 and 34 for supporting and guiding the head assembly 31 and anvil assembly 32 in a direction perpendicular to the sheet conveyance direction; guide screw shafts 35 and 36 with helical screws for sliding the head assembly 31 and anvil assembly 32 in the direction perpendicular to the sheet conveyance direction; and an anvil driving shaft 37 and a head driving shaft 38 having a square cross section for controlling the head assembly 31 and anvil assembly 32 to perform a staple driving operation and staple folding operation, respectively.

The head assembly 31 and anvil assembly 32 engage the guide screw shafts 36 and 35, respectively. When the guide screw shafts 36 and 35 rotate, the head assembly 31 and anvil assembly 32 move leftward or rightward in FIG. 6. A stapler slide motor 42 is arranged on an outer surface of the unit frame 41 to rotate the guide screw shaft 36 in a forward or reverse direction via gears. At the same time, the rotation of the stapler slide motor 42 is transferred to the anvil assembly 32 through a timing belt 43 entrained around pulleys fixed to the guide screw shafts 36 and 35 outside the unit frame 41. A stapling/folding stepping motor 170 (see FIG. 11) rotates the head driving shaft 38 via a coupling device 44 arranged outside the unit frame 41. The stapling/folding motor 170 also drives the anvil assembly 32 through a timing belt 45 entrained around pulleys fixed to the head driving shaft 38 and anvil driving shaft 37 outside the unit frame 40. In this arrangement, the head assembly 31 and anvil assembly 32 move in synchronization with each other in the direction perpendicular to the sheet conveyance direction without destroying an alignment therebetween. The stapler slide motor 42 is controlled to move the head assembly 31 and anvil assembly 32 to drive the staple into the sheets S at any appropriate position in accordance with the width of the sheets S.

As shown in FIG. 2, the folding unit 50 is constructed in a unit represented by a phantom line and arranged at downstream of the stapler unit 30. Like the stapler unit 30, the folding unit 50 is also detachable from the sheet post-processing device 2.

In a general configuration of the folding unit 50, a stack conveyance upper roller 51 and stack conveyance lower roller 52 for nipping and conveying the sheet stack in a downstream direction are arranged at an entrance of the folding unit 50. A stack conveyance guide 53 is arranged at downstream of the stack conveyance upper roller 51 and stack conveyance lower roller 52 for guiding the sheet stack conveyed from the roller pair further in a downstream direction. An edge detector sensor 54 formed of an integrated emitter-receptor type sensor for detecting a forward edge of the sheet stack is arranged in the sheet stack conveyance path of the stack conveyance guide 53. In response to a signal of detecting the forward edge of the sheet stack, a control unit (described later) controls the stack conveyance upper roller 51 to press against the stack conveyance lower roller 52 while controlling a folding position of the sheet stack in the sheet conveyance direction.

The stack conveyance upper roller 51 moves between a position (represented by a solid line) where the stack conveyance upper roller 51 is pressed against the stack conveyance lower roller 52 and a spaced position (represented by a phantom line in FIG. 8B) where the stack conveyance upper roller 51 is away from the stack conveyance lower roller 52. The stack conveyance upper roller 51 remains away from the stack conveyance lower roller 52 until the edge detector sensor 54 detects the forward edge of the sheet stack, and the two rollers 51 and 52 are pressed against with each other when the edge detector sensor 54 detects the forward edge of the sheet stack.

A pair of folding rollers 57*a* and 57*b* is arranged below the stack conveyance guide 53, and is pressed against each other in a direction perpendicular to the sheet stack conveyance direction to fold the sheet stack. Each of the rollers 57*a* and 57*b* has a diameter (for example, 40 mm) so that each roller rotates at least one revolution when folding the sheet stack.

A pushing plate 55 is arranged at downstream of the stack conveyance guide 53 in a direction perpendicular to the sheet stack conveyance direction. An edge of the pushing plate 55 moves close to the contact position of the folding rollers 57*a* and 57*b* to push the sheet stack into the contact position between the folding rollers 57*a* and 57*b*. The pushing plate 55 is formed of stainless steel, and the edge thereof has a thickness of 0.25 mm.

Backup guides 59*a* and 59*b* having semicircular shapes in cross section are arranged above the folding rollers 57*a* and 57*b* to assist the stack conveyance guide 53 to guide the sheet stack. As described later, the backup guides 59*a* and 59*b* move up and down in a direction perpendicular to the sheet stack conveyance direction in an interlocking manner. When the edge of the pushing plate 55 moves close to the nip between the folding rollers 57*a* and 75*b*, the backup guides 59*a* and 59*b* open circumferences of the folding rollers 57*a* and 57*b* relative to the sheet stack.

Figure 7:
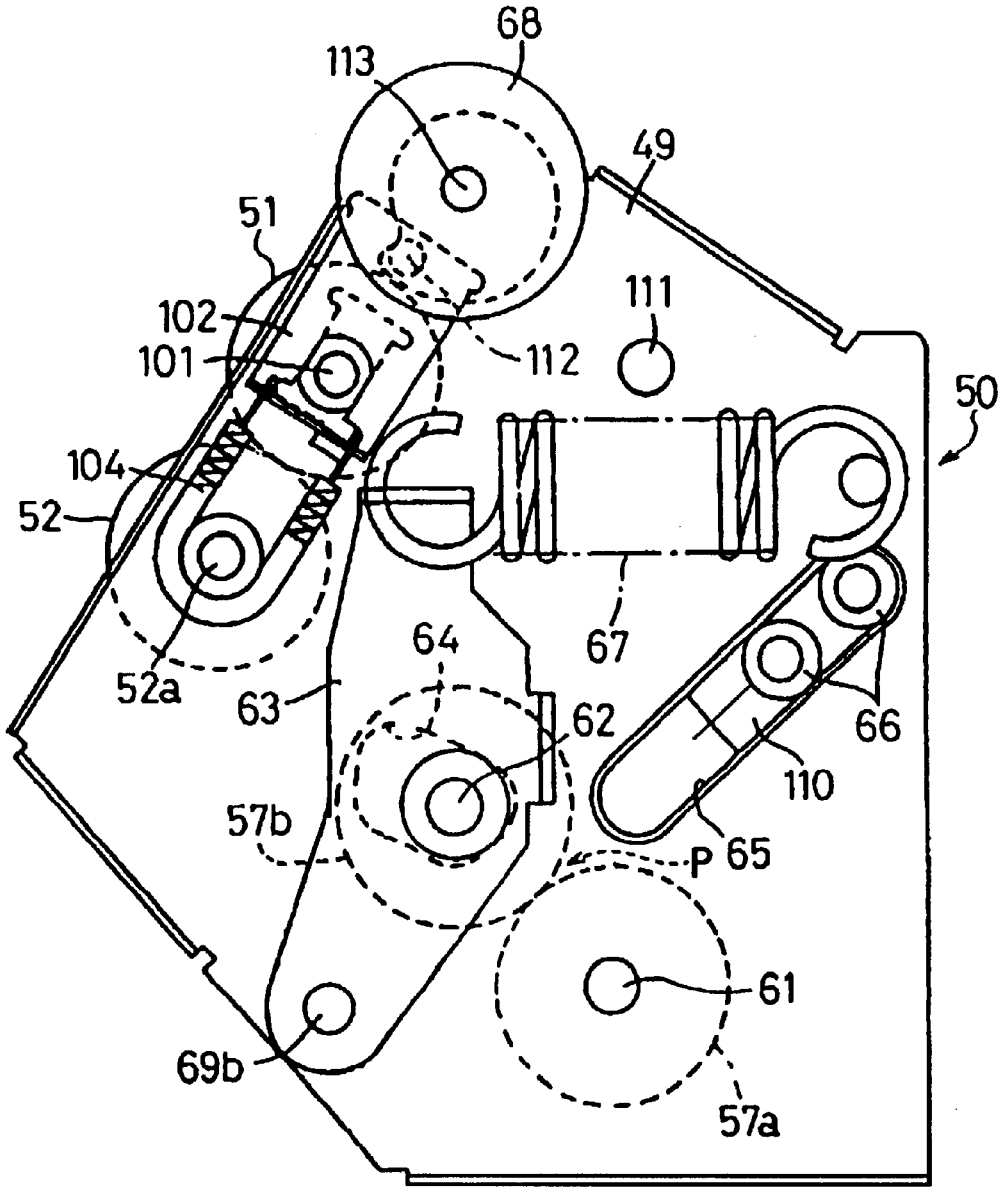
FIG. 7 is a side view showing a folding unit of the sheet post-processing device.

The folding unit 50 will be described below in detail. As shown in FIG. 7, the folding rollers 57*a* and 57*b* are fixed to roller driving shafts 61 and 62 rotatably supported by a unit frame 49, respectively. A bow-shaped (boomerang-like) roller holder 63 is attached to the folding roller driving shaft 62 passing through the center of the folding roller holder 63. One end of the folding roller holder 63 is pivotally supported on a fixed shaft 69*b* fixed to the unit frame 49. The other end of the folding roller holder 63 is pulled by a pulling spring 67 anchored in the unit frame 49 with a force of about 49 N (5 kgf). A guide hole 64 is provided in the unit frame 49 for allowing the folding roller driving shaft 62 to move when the folding roller driving shaft 62 rotates. When the folding rollers 57*a* and 57*b* fold the sheet stack, the pulling spring 67 applies a constant pressure to the sheet stack to assure the folding operation.

The pushing plate 55 is projected from a roll 66 movably housed in a support holder 110. The unit frame 49 has a pushing plate guide slot 65 for guiding the roll 66 within the support holder 110. The pushing plate 55 moves to the nip P of the folding rollers 57*a* and 57*b* while being guided by the pushing plate guide slot 65.

An upper roller shaft 101 of the stack conveyance upper roller 51 and lower roller shaft 52*a* of the stack conveyance lower roller 52 for transporting the sheet stack into the folding unit 50 are supported in the unit frame 49. The stack conveyance upper roller 51 and stack conveyance lower roller 52 need to be apart with each other until the sheet stack is transported into the folding unit 50. Thus, the following mechanism is formed to maintain the stack conveyance upper roller 51 in a position away from the stack conveyance lower roller 52.

A bearing holder 102 supports the upper roller shaft 101, and a cam follower 112 projects from the top end of the bearing holder 102. The cam follower 112 engages an upper roller movement cam 68 rotatably supported on the unit frame 49. A pulling spring 104 with a force of 2.9 N (about 300 gf) extends between lower ends of the bearing holder 102 and the stack conveyance lower roller 52*a* to press the stack conveyance upper roller 51 against the stack conveyance lower roller 52. The bearing holder 102 is lifted against the pulling spring 104 with the rotation of the upper roller movement cam 68. Accordingly, the stack conveyance upper roller 51 is movable between the position away from the stack conveyance lower roller 52 and the contact position.

Figure 8:
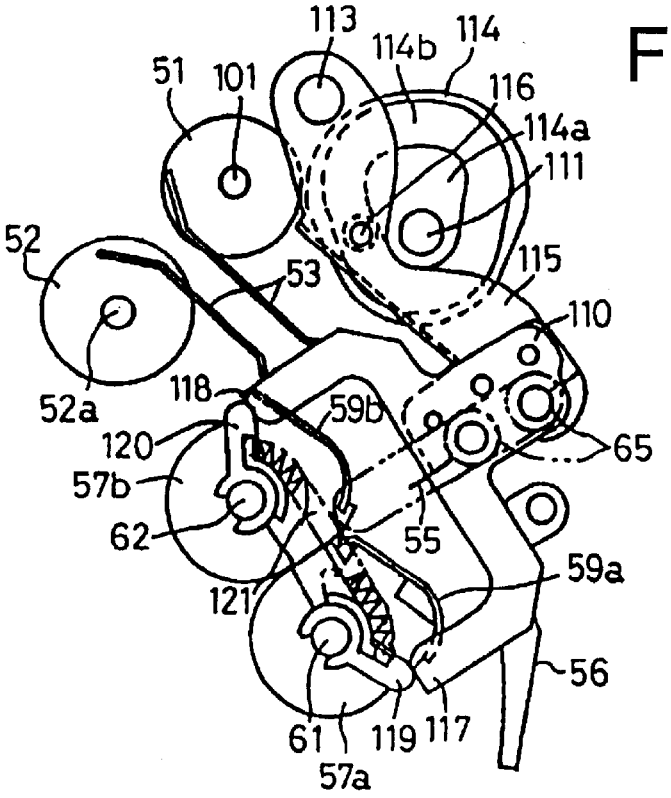
FIG. 8(A) is a side view of a folding mechanism of the folding unit.
FIG. 8(B) is a side view of the folding mechanism in a folding operation thereof.
Figure 8:
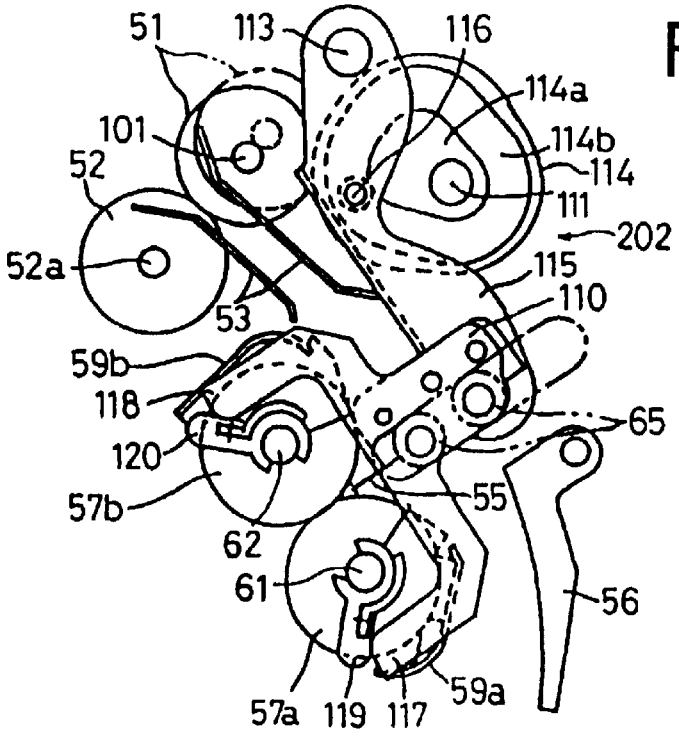

As shown in FIG. 8, the folding unit 50 includes a cam plate 114 having a cam 114*a* for moving the pushing plate 55. The cam plate 114 is fixed to a cam driving shaft 111 supported on the unit frame 49. A cam timing of the cam plate 114 is set so that the pushing plate 55 moves about twice as fast as the folding rollers 57*a* and 57*b* move, and the pushing plate 55 is clear of both edges of the sheet stack even if the pushing plate 55 pushes twice or more.

The pushing plate 55 moves at a speed predetermined times multiplied by the conveyance speed of the folding rollers 57*a* and 57*b*. Therefore, a period of time for a stitched position of the sheet stack conveyed by the folding rollers 57*a* and 57*b* to reach the nip P becomes substantially equal to a period of time for the pushing plate 55 to reach the nip of the folding rollers 57*a* and 57*b* after the pushing plate 55 contacts the stitched position of the sheet stack. Accordingly, the two movements are performed in synchronization. The pushing plate 55 is mechanically set so not as to contact both edges of the folded sheet stack having a predetermined size after the pushing plate pushes twice. In addition to this setting of the pushing plate 55, the folding rollers 57*a* and 57*b* have also a predetermined roller diameter for setting a timing of folding. That is, the folding operation is performed at the two timings, thus, regardless of the size of the sheet S, the pushing plate 55 is prevented from touching both edges of the sheet S.

An actuator arm 115 having a bow shape in cross-section is pivotally supported at one end thereof on a shaft 113 of the upper roller movement cam 68. The support holder 110 is fixed to the other end of the actuator arm 115 as a pivot. The cam plate 114 has a cam groove 114*b*. A cam follower 116 projected from an approximate center of the actuator arm 115 is inserted in the cam groove 114*b*. When the cam plate 114 rotates, the cam 114*a* pushes the cam follower 116 to lift the actuator arm 115. Then, the pushing plate 55 fixed to the actuator arm 115 becomes movable between a position for pushing the sheet stack and a standby position.

Levers 119 and 120 are rotatably supported on the folding roller driving shafts 61 and 62 of the folding rollers 57*a* and 57*b*, respectively. The levers 119 and 120 are provided with backup guides 59*a* and 59*b* for covering the circumferences of the folding rollers 57*a* and 57*b*. The backup guides are able to rotate around the folding roller driving shafts 61 and 62 with respect to the circumferences of the folding rollers 57*a* and 57*b*. The backup guides 59*a* and 59*b* are also pulled to each other by a spring 121. Ends of the levers 119 and 120 contact end portions 117 and 118 branched from the support holder 110 to be supported.

A guide 56 is disposed below the support holder 110 for changing the conveyance direction of the sheet stack nipped between and conveyed by the stack conveyance upper roller 51 and stack conveyance lower roller 52 to a downward direction. The guide 56 guides the sheet stack so that the forward edge of the sheet stack is suspended downward in a sheet stack passage 58 (see FIG. 2) formed between a device frame 2A and the folding unit 50.

As shown in FIG. 8(A), when the stack conveyance upper roller 51 is spaced apart from the stack conveyance lower roller 52, the backup guides 59*a* and 59*b* are positioned to cover the circumferences of the folding rollers 57*a* and 57*b* facing the conveyance passage. Accordingly, the backup guides 59*a* and 59*b* become an extension of the lower stack conveyance guide 53, thereby assisting the stack conveyance guide 53 to convey the sheet S.

As shown in FIG. 8(B), when the folding operation for folding the sheet stack is performed, the support holder 110 is lowered toward the nip P between the folding rollers 57*a* and 57*b*. The levers 119 and 120 are lowered by the end portions 117 and 118, and the backup guides 59*a* and 59*b* rotate around the folding roller driving shafts 61 and 62 against the spring 121, thereby allowing the circumferences of the folding rollers 57*a* and 57*b* to abut against the sheet stack.

The drive transfer system of the folding unit 50 is divided into a stack conveyance roller driving system for driving (rotating and moving) the stack conveyance upper roller 51 and stack conveyance lower roller 52, and a folding roller/pushing plate driving system for rotating the folding rollers 57*a* and 57*b* while moving the pushing plate 55. These subsystems are arranged on a deep side of the unit frame 49 shown in FIG. 7.

Figure 9:
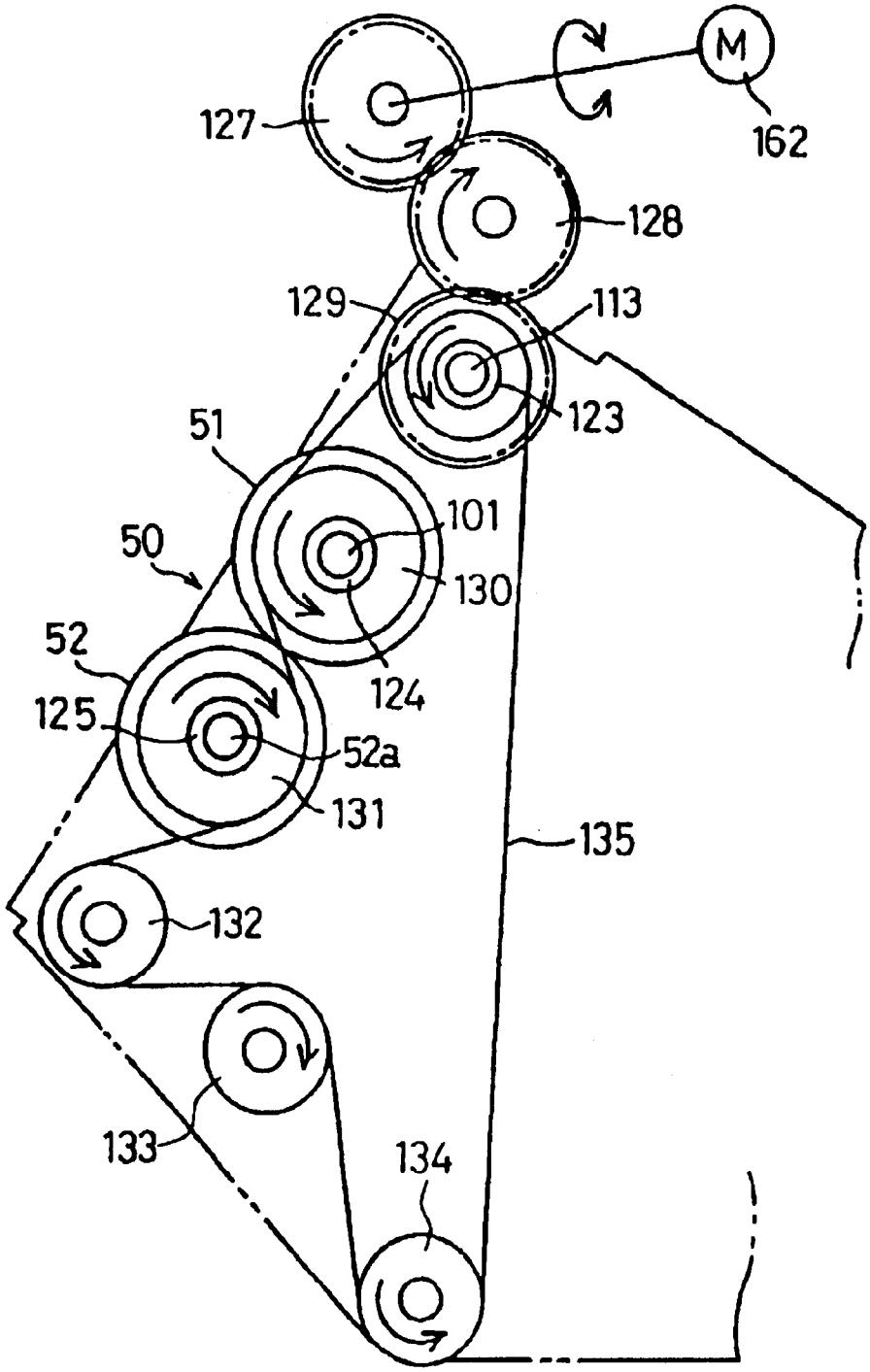
FIG. 9 is a side view of a driving system of a conveyance roller of the folding unit.

As shown in FIG. 9, the stack conveyance roller driving subsystem is driven by a conveyance motor 162 formed of a stepping motor capable of rotating in both directions. The rotation of the conveyance motor 162 is transferred to a gear pulley 129 through gears 127 and 128. A one-way clutch 123 is interposed between the gear pulley 129 and the shaft 113 that drives the upper roller movement cam 68. Due to the one-way clutch 123, the upper roller movement cam 68 rotates to move the stack conveyance upper roller 51 vertically only when the gears 127 and 128 rotate in directions opposite to the arrow directions, respectively.

Pulleys 130 and 131 transfer the rotation of the gear pulley 129 to the upper roller shaft 101 and lower roller shaft 52*a* through a timing belt 135. A one-way clutch 124 is interposed between the pulley 130 and the upper roller shaft 101, and a one-way clutch 125 is interposed between the pulley 131 and the lower roller shaft 52*a*. The upper roller shaft 101 and lower roller shaft 52*a* rotate only when the pulleys 130 and 131 rotate in the arrow directions in FIG. 9. The timing belt 135 is also entrained around pulleys 132, 133, and 134.

When the gears 127 and 128 rotate in the arrow directions in FIG. 9, the stack conveyance upper roller 51 and stack conveyance lower roller 52 rotate in directions to convey the sheet stack in the folding unit 50. When the gears 127 and 128 rotate in the directions opposite to the arrow directions, the upper roller movement cam 68 rotates as described above, thereby moving the stack conveyance upper roller 51 away from the stack conveyance lower roller 52. A control unit 149 (described later) controls these operations when sensors detect flag pegs (not shown) fixed to a shaft 132 of the pulley 133.

Figure 10:
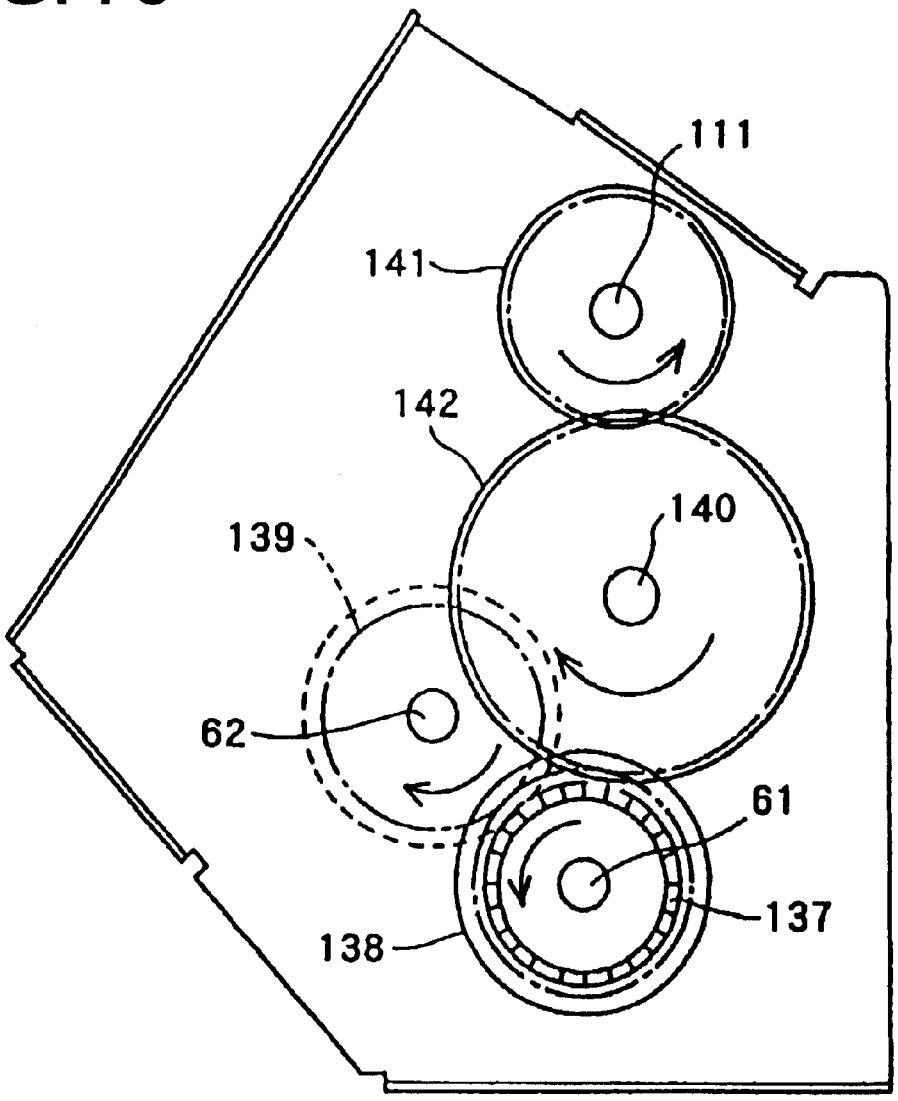
FIG. 10 is a side view of a driving system of a folding roller and pushing plate in the folding unit.

As shown in FIG. 10, the stapling/folding motor 170 (see FIG. 11) drives the folding roller/pushing plate driving system through a coupling device 137 attached to the folding roller driving shaft 61. The stapling/folding motor 170 drives the coupling device 44 of the stapler unit 30 shown in FIG. 6 in a forward direction, and drives the coupling device 137 in a reverse direction through a drive transfer system (not shown). The rotation of the coupling device 137 is transferred to a gear 139 fixed to the folding roller driving shaft 62 through the gear 138 fixed to the folding roller driving shaft 61. Furthermore, the rotation of the gear 138 is transferred to the cam driving shaft 111 of the cam plate 114 through a gear 142 rotatable around a shaft 140 and a gear 141 engaging the gear 142. The cam plate 114 activates the actuator arm 115 to move the pushing plate 55. The control unit (described later) determines a position of the cam plate 114 when a sensor detects a flag peg (not shown) attached to the cam driving shaft 111.

As shown in FIG. 2, a folded sheet stack discharge stacker 80 is disposed at downstream of the folding unit 50 at a bottom of the sheet post-processing device 2 for stocking a sheet stack folded by the folding unit 50. The discharge stacker has a plane tilted opposite to that of the offset unit 20, stapler unit 30, and stapler unit 30. A folded sheet pressure member 81 with one end thereof pivotally supported is arranged above the folded sheet stack discharge stacker 80. The folded sheet pressure member 81 folds and presses the discharged sheet stack using an urging force of a spring or the like in cooperation with the force of gravity of the sheet stack along the tilted plane of the folded sheet stack discharge stacker 80.

A lifting tray 90 is arranged on a sidewall of the device frame 2A at a side opposite to the copying apparatus main unit 1. The lifting tray 90 moves vertically with respect to the device frame 2A. The lifting tray 90 is supported by a lifting tray support 92. A lifting tray motor 155 (see FIG. 11) formed of a stepping motor capable of rotating in both directions drives the lifting tray support 92 to move vertically through a belt (not shown). The lifting tray 90 is raised and lowered between an upper limit position represented by a solid line and a lower limit position represented by a phantom line in FIG. 2.

The lifting tray 90 includes an auxiliary tray 91 detachable from the lifting tray 90. The auxiliary tray 91 is pulled out from the lifting tray 90 to place a large-size sheet thereon. A sheet surface sensor 93 is arranged below the second pulley 11 of the offset unit 20 for detecting a surface of the uppermost sheet on the lifting tray 90. A trailing edge guide 94 is arranged on the sidewall of the lifting tray 90 of the device frame 2A for guiding a trailing edge of the sheet on the lifting tray 90 when the lifting tray 90 moves. When the folding unit 50 folds the sheet stack, the sheet stack is placed on the folded sheet stack discharge stacker 80. When there is no folding operation, the sheet stack is placed on the lifting tray 90.

Figure 11:
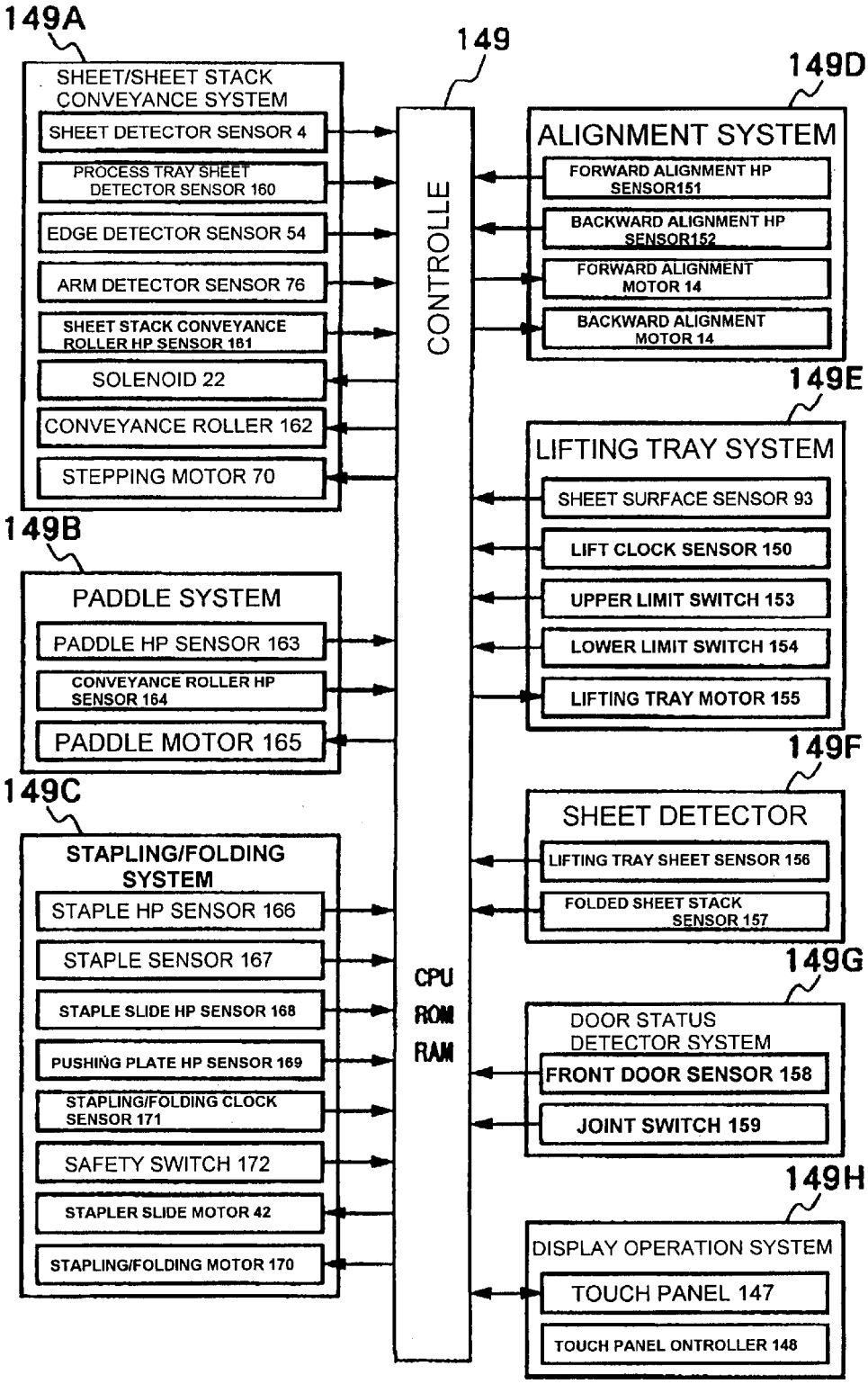
FIG. 11 is a block diagram illustrating a relationship between a control unit and sensors/actuators in the sheet post-processing device.

As shown in FIG. 11, a control unit 149 includes a central processing unit (CPU), a ROM for storing a program to be executed by the CPU and program data in advance, a RAM for working as a work area for the CPU and for storing control data received from a control unit 950 in the copying apparatus main unit 1 (see FIG. 1), and interfaces. The control unit 149 controls a sheet/sheet-stack conveyance system 149A, a paddle system 149B, a stapling/folding system 149C, an alignment system 149D, a lifting tray system 149E, a sheet detector system 149F, a door status detector system 149G, and a display operation system 149H. As for a component having two identical parts as shown in FIG. 2, one of the two parts located at a forward side is referred to as a "forward" component, and the other part located at a backward side is referred to as a "backward" component in FIG. 11.

The sheet/sheet-stack conveyance system 149A as an input to the control unit 149 works for conveyance of the sheet S and sheet stack. The sheet/sheet-stack conveyance system 149A includes a sheet detector sensor 4 for detecting the sheet S on the conveyance guide 3, an edge detector sensor 54 for detecting the edge of the sheet stack, an arm detector sensor 76 for detecting the HP position of the pushing nail 13, and a sheet stack conveyance roller HP sensor 161 for detecting the home position where the stack conveyance upper roller 51 is away from the stack conveyance lower roller 52.

Output components of the control unit 149 include the solenoid 22 for positioning the stopper 21 at one of the restraining position and retraction position; a conveyance motor 162 for driving the pair of the conveyance rollers 5, the pair of the discharge rollers 6, the stack conveyance upper roller 51, and the stack conveyance lower roller 52 while rotating the upper roller movement cam 68 to move the stack conveyance upper roller 51; and a stepping motor 70 for driving the conveyance lower roller 18, conveyance upper roller 19, and conveyance belt 12. The conveyance motor 162 and stepping motor 70 are controlled through motor drivers, and the solenoid 22 is controlled through a solenoid control unit. The motor drivers and the solenoid control unit are not shown in FIG. 11 (same for the following output components).

The paddle system 149B includes, as input components thereof, a paddle HP sensor 163 for detecting a position of rotation of the paddle 17, and a conveyance roller HP sensor 164 for detecting a position where the conveyance upper roller 19 is disengaged from the conveyance lower roller 18, and as an output component, a paddle motor 165 for driving the paddle 17.

The stapling/folding system 149C includes, as input components thereof, a staple HP sensor 166 for detecting completion of preparation of the head assembly 31 and anvil assembly 32 for driving and folding a staple; a staple sensor 167 for detecting that a staple is set in the head assembly 31; a staple slide HP sensor 168 for detecting that the head assembly 31 and anvil assembly 32 are placed at the initial positions thereof in the sheet conveyance direction; a pushing plate HP sensor 169 for detecting the home position of the pushing plate 55; a clock sensor 171 for detecting the rotational direction of the stapling/folding motor 170 that switches the rotational direction for driving between the staple unit and folding unit; and a safety switch 172 for detecting that the stapler unit 30 and folding unit 50 are ready for the operation.

The stapling/folding system 149C includes, as output components thereof, the stapler slide motor 42 for rotating the guide screw shaft 36 that drives the head assembly 31 and anvil assembly 32 in a direction perpendicular to the sheet conveyance direction; and the stapling/folding motor 170 for driving the coupling device 44 of the stapler unit 30 in the normal direction and the coupling device 137 of the folding unit 50 in the reverse direction.

The alignment system 149D includes, as input components, a forward alignment HP sensor 151 and backward alignment HP sensor 152 for detecting the home position of the alignment plate 9 that aligns both edges of the sheet S on the process tray 8, and as an output component, forward and backward alignment motors 14 for driving the alignment plate 9. The alignment motors 14 can be shifted freely in a direction perpendicular to the sheet and sheet stack conveyance direction.

The lifting tray system 149E includes, as an output component, the lifting tray motor 155 for moving the lifting tray 90, and as input components, the sheet surface sensor 93 for detecting the surface of the uppermost sheet on the lifting tray 90, the lift clock sensor 150 for detecting an amount of rotation of the lifting tray motor 155, and an upper limit switch 153 and a lower limit switch 154 for regulating a vertical range of the lifting tray 90.

The sheet detector system 149F includes a lifting tray sheet sensor 156 for detecting the sheet stack on the lifting tray 90 to determine whether the lifting tray 90 and folded sheet stack discharge stacker 80 hold the sheet S or the sheet stack, and a folded sheet stack sensor 157 for detecting the sheet stack on the folded sheet stack discharge stacker 80. The sensors 156 and 157 detect the sheet or the sheet stack for warning an operator if the sheet S remains when the sheet post-processing device 2 starts, or if the sheet is not removed after a predetermined period of time.

The door status detector system 149G includes a front door sensor 158 and joint switch 159 for detecting whether the sheet post-processing device 2 is appropriately mounted on the copying apparatus main unit 1, so that the door status detector system 149G determines whether the door attached to the device frame 2A opens, and whether the sheet post-processing device 2 is properly mounted to the copying apparatus main unit 1.

The display operation system 149H includes a touch panel 147 such as a liquid-crystal display, and touch panel control unit 148 for controlling the touch panel 147, so that the display operation system 149H displays the progress of the processes and receives an operation command from the operator.

An operation of the copying apparatus 1A of the embodiment will be explained. The copying apparatus main unit 1 and sheet post-processing device 2 will be separately described.

When the control unit 950 sends a signal for feeding the sheet according to the operation command from an operation unit (not shown), the sheet S is fed from the sheet feeder 909. The register roller pair 901 corrects a skew of the sheet S, and feeds the sheet to the image forming assembly 902 at an adjusted timing. The light source 907 irradiates on the original document D placed on the platen glass 906, and the reflected light is then incident on the photoconductive drum 914 through the optical system 908. The primary charging unit 919 charges the photoconductive drum 914 in advance, so that an electrostatic latent image is formed on the photoconductive drum 914. The development unit 915 develops the electrostatic latent image to form a toner image on the photoconductive drum 914.

In the image forming assembly 902, the transfer unit 916 transfers the toner image on the photoconductive drum 914 to the supplied sheet S. The separating charging unit 917 charges the sheet S with the toner image into a polarity opposite to that of the transfer unit 916, so that the sheet is separated from the photoconductive drum 914.

The endless conveyance belt 920 conveys the sheet S separated from the photoconductive drum 914 to the fixing unit 904. The fixing unit 904 permanently fixes the transferred image onto the sheet S, thereby forming (recording) the image on the sheet S. The pair of the discharge rollers 905 discharges the sheet S with the image into the sheet post-processing device 2 from the copying apparatus main unit 1. In this way, the image is formed on the sheets S fed from the sheet feeder 909, and the sheet S with the image is successively discharged into the sheet post-processing device 2.

Typical modes of the sheet post-processing device 2 for processing the sheet S includes (1) a non-stapling mode in which the sheet stack is placed in the lifting tray 90 without performing the stitching operation thereon, (2) a side stapling mode in which the sheet stack is placed in the lifting tray 90 after performing the stitching operation at least one position at the edge of the sheet stack in the conveyance direction, (3) a saddle stitching mode in which the stitching operation is performed at least at one position at the middle of the sheet in the sheet conveyance direction, the stitched sheet stack is folded into the booklet, and the booklet is collected in the folded sheet stack discharge stacker 80, and (4) an offset mode in which the stitching operation and/or the folding operation is performed on the sheet stack at a predetermined position with the edge of the sheet successively offset (described later). An operation of the sheet post-processing device 2 in these modes will be explained below. The operator selects these modes through the touch panel 147 to store in the RAM in the control unit 149.

When the non-stapling mode is selected, the control unit 149 activates the stepping motor 70 to move the pushing nail 13 from the HP position shown in FIG. 4 to a pre-home position (hereinafter referred to as pre-HP position) serving as a reference for sheet collection on the process tray 8. At this time, the conveyance upper roller 19 is at the spaced position, and the stopper 21 is at the retraction position. As shown in FIG. 4, the pre-HP position is away from the HP position of the pushing nail 13 by a distance ($L2+\alpha$), and is closer to the lifting tray 90 by a distance $\alpha$ than the contact point Q between the conveyance lower roller 18 and conveyance upper roller 19. It is possible to control the travel distance ($L2+\alpha$) through the number of steps of the stepping motor 70.

Concurrently, the control unit 149 activates the conveyance motor 162 to rotate the driving rollers of the conveyance roller pair 5, and discharge roller pair 6 until the sheet S is discharged from the discharge roller pair 905 in the copying apparatus main unit 1. When the sheet S is discharged from the copying apparatus main unit 1, the sheet S is then conveyed to the process tray 8 by the conveyance roller pair 5 and discharge roller pair 6. When the sheet detector sensor 4 detects the sheet S, the control unit 149 measures start timings of the alignment motor 14 to move the alignment plate 9 and paddle motor 165 to rotate the paddle 17. The control unit 149 receives information regarding the size of the sheet S and the direction of the sheet with respect to the conveyance direction from the control unit 950 of the copying apparatus main unit 1, and stores the information in the RAM.

When the sheet S is discharged into the process tray 8, the alignment motor 14 and paddle motor 165 are activated. In response, the alignment plate 9 moves in the width direction perpendicular to the sheet conveyance direction to align both edges of the sheet S. The paddle 17 rotates so that the edge of the sheet S is aligned along the end of the pushing nail 13 situated at the pre-HP position. These steps of operation are repeated every time when the sheet S is discharged into the process tray 8.

When a predetermined number of the sheets S are aligned along the end of the pushing nail 13, the conveyance motor 162 and paddle motor 165 are stopped. The stepping motor 70 is activated to move the conveyance belt 12, so that the end of the pushing nail 13 pushes the sheets S toward the lifting tray 90 (in the arrow direction A in FIGS. 2 and 4). Accordingly, the sheet stack is collected in the lifting tray 90. As shown in FIG. 4, the distance L1 is set to be smaller than the distance L2. Therefore, the end of the pushing nail 13 can pushes the edge of the sheet stack in an upright position toward the lifting tray 90, thereby eliminating an extra stress in the sheet stack during the movement.

When the sheet stack is placed on the lifting tray 90, the lifting tray motor 155 rotates to lower the lifting tray 90 by a certain distance. Then, the lifting tray motor 155 rotates in a reverse direction, thereby raising the lifting tray 90 to a position where the sheet surface sensor 93 detects the surface of the uppermost sheet of the stack. The lifting tray 90 remains at this position until the next sheet stack is placed.

In the non-stapling mode with no stitching process, without moving the sheet S to the restraining position of the stopper 21, the pushing nail 13 is positioned at the pre-HP position in advance to stack the sheets and push the sheet stack toward the lifting tray 90. Thus, Even if a sheet discharge rate of the copying apparatus main unit 1 is high, the sheet post-processing device 2 can keep up with the discharge rate.

If the pre-HP position of the pushing nail 13 overlaps the conveyance path guide 7 above the pushing nail 13, the sheets S successively brought in are more reliably stacked along the end of the pushing nail 13.

When the side stapling mode is selected, the control unit 149 activates the stapler slide motor 42 to move the head assembly 31 and anvil assembly 32 to the initial position where the staple slide HP sensor 168 detects. The control unit 149 turns on the solenoid 22 to move the stopper 21 to the restraining position.

The control unit 149 activates the conveyance motor 162 to rotate the conveyance roller pair 5 and discharge roller pair 6 to discharge the sheet S into the process tray 8 from the copying apparatus main unit 1. The alignment motor 14 and paddle motor 165 are then activated. The both sides of the sheet S in the width direction are aligned along the alignment plate 9, and the stopper 21 stops the sheet after reaching the sidewall of the leg of the stopper 21. This step is repeated by a predetermined number of times so that the sheet stack is in a restrained state by the stopper 21.

While the sheet stack is in the restrained state by the stopper 21, the conveyance upper roller 19 move toward the conveyance lower roller 18 to nip the sheet stack. Then, the solenoid 22 is turned off, and the stopper 21 moves to the retraction position. After that, the stepping motor 70 rotates by a predetermined number of steps in a direction opposite to the direction thereof in the non-stapling mode. Accordingly, the conveyance upper roller 19 and conveyance lower roller 18 with the sheet stack nipped therebetween convey the sheet stack toward the stapler unit 30 in the arrow direction B in FIG. 2 until the stitching position of the sheet stack reaches a head position of the head assembly 31 located at the initial position. The one-way clutch 75 (see FIG. 3) is interposed between the first pulley shaft 10*a* and first pulley 10 around which the conveyance belt 12 is entrained. Therefore, when the stepping motor 70 rotates in the reverse direction in this way, the rotation of the stepping motor 70 is not transferred to the conveyance belt 12, and the conveyance belt 12 and pushing nail 13 remain stationary.

The control unit 149 activates the stapling/folding motor 170 to perform the stitching operation on the edge of the sheet stack with the head assembly 31 and anvil assembly 32. When the stitching operation is performed at several positions, the control unit 149 activates the stapler slide motor 42 to move the unit frame 40 before the stitching operation.

When the stitching operation is completed, the stepping motor 70 drives the conveyance lower roller 18, conveyance upper roller 19, and conveyance belt 12 toward the lifting tray 90. Accordingly, after the stitching operation, the sheet stack is handed over to the pushing nail 13 from the conveyance lower roller 18 and conveyance upper roller 19. The pushing nail 13 pushes the sheet stack to place on the lifting tray 90. The remaining operation of the side stapling mode is the same as that of the non-stapling mode, and the explanation thereof is omitted.

When the saddle stitching mode is selected, similar to the side stapling mode, the sheet S discharged from the copying apparatus main unit 1 is placed on the process tray 8. After placed on the process tray 8, the conveyance upper roller 19 is lowered toward the conveyance lower roller 18 to nip the sheet stack. At the same time, the solenoid 22 is turned off, and the stopper 21 moves to the retraction position.

The stepping motor 70 rotates in a direction opposite the that in the non-stapling mode. The sheet stack, while being nipped between the conveyance upper roller 19 and conveyance lower roller 18, is conveyed toward the stapler unit 30. In this state, the head assembly 31 and anvil assembly 32 remain stationary at the initial positions thereof in a direction perpendicular to the sheet conveyance direction.

When the edge detector sensor 54 detects the forward edge of the sheet stack after the start of conveyance of the sheet stack, the control unit 149 conveys the sheet stack according to the information regarding the length of the sheet in the sheet conveyance direction received from the copying apparatus main unit 1 and stored in the RAM, until the center of the sheet in the sheet conveyance direction reaches the stitching position. Then, the stepping motor 70 stops.

The stapling/folding motor 170 drives the head driving shaft 38 and anvil driving shaft 37 to perform the stitching operation. If the stitching operation is performed at several stitching positions, the stapler slide motor 42 is activated.

The guide screw shafts 35 and 36 rotate to move the head assembly 31 and anvil assembly 32 to a predetermined position in a direction perpendicular to the sheet conveyance direction, and then the stitching operation is performed. When the sheet stack is conveyed to the stitching position, the forward edge of the sheet stack has already passed the stack conveyance lower roller 52 and stack conveyance upper roller 51 in the spaced position in the folding unit 50.

To perform the folding operation, the conveyance motor 162 rotates in a reverse direction to rotate the upper roller movement cam 68 (see FIG. 7). The stack conveyance upper roller 51 is lowered toward the stack conveyance lower roller 52 through the bearing holder 102. The sheet stack is nipped by means of the pulling spring 104. The conveyance upper roller 19 moves to the spaced position to disengage the sheet stack.

Next, the conveyance motor 162 is activated to rotate the stack conveyance upper roller 51 and stack conveyance lower roller 52 to convey the sheet stack further in a downstream direction. During the conveyance, the control unit 149 decelerates and then stops the conveyance motor 162 in accordance with a signal detected by the edge detector sensor 54 and sheet length information stored in the RAM so that a center point of the sheet in the sheet conveyance direction, i.e. the stitching point, becomes the folding position. In this state, the forward edge of the sheet stack is suspended in the sheet stack passage 58 with the center point nipped between the stack conveyance upper roller 51 and stack conveyance lower roller 52 (see FIG. 2 and FIG. 12(B)).

Figure 12A:
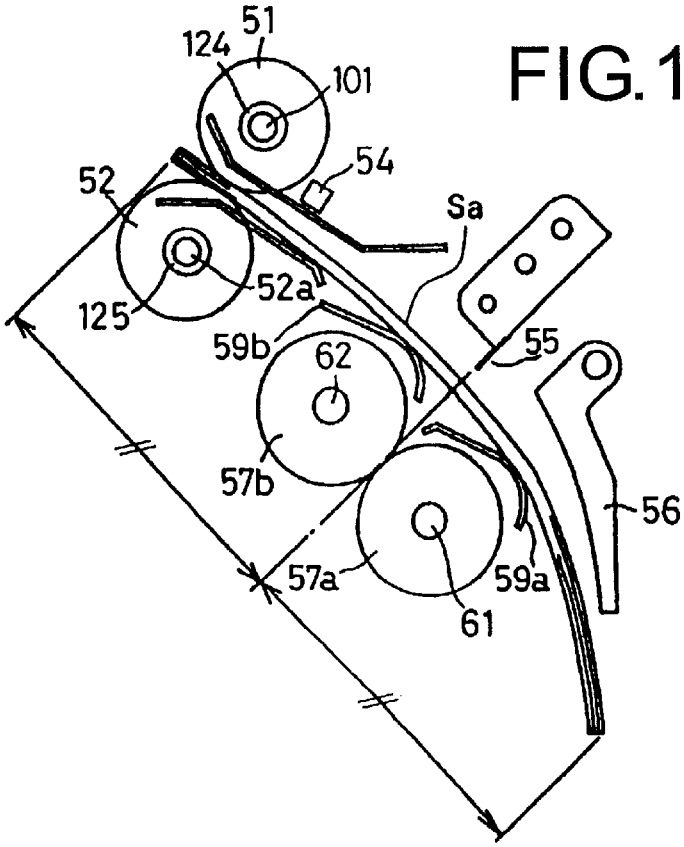
Figure 12B:
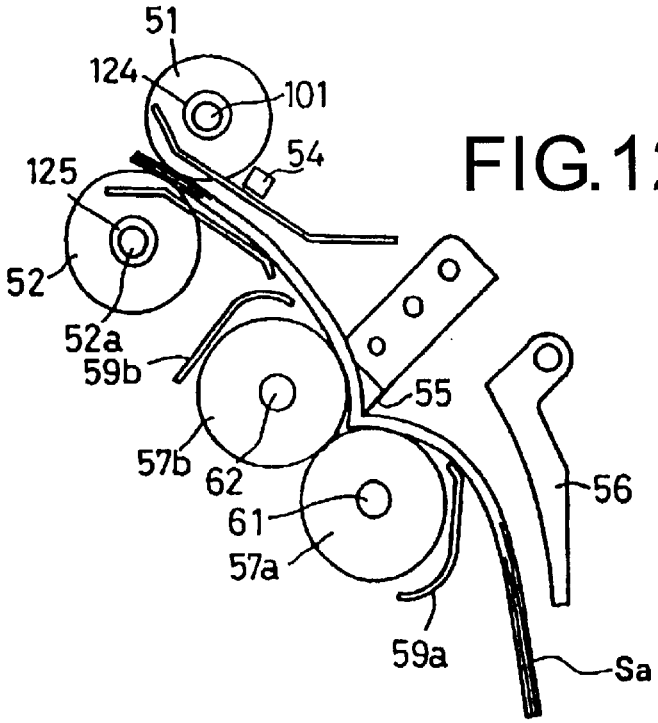

Then, the stapling/folding motor 170 rotates in a direction opposite to that for the stitching operation. As shown in FIG. 8(B) and FIG. 12(B), the folding rollers 57*a* and 57*b* rotate in a direction to nip the sheet stack Sa, and at the same time, the pushing plate 55 is lowered. In synchronization with the lowering operation of the pushing plate 55, the backup guides 59*a* and 59*b* move to expose the circumferences of the folding rollers 57*a* and 57*b* toward the sheet stack Sa. When the pushing plate 55 is lowered, the sheet stack Sa is pulled in between the folding rollers 57*a* and 57*b*. The pushing plate 55 is then spaced away from the sheet stack Sa, and the sheet stack Sa is further pulled between the folding rollers 57*a* and 57*b* (i.e., conveyed in the nipped state).

The sheet stack Sa conveyed in the nipped state is then discharged into and stocked on the folded sheet stack discharge stacker 80. At this time, the folded sheet pressure member 81 pushes the sheet stack Sa, thus the folded sheet stack (the booklet) does not open and interfere with the next booklet.

After the start of the folding operation, when the pushing plate HP sensor 169 detects that the pushing plate 55 moves back and forth a predetermined number of times according to the length of the sheet stack Sa in the sheet conveyance direction, the control unit 149 stops the stapling/folding motor 170. After the sheet stack Sa is nipped between the folding rollers 57*a* and 57*b*, the stack conveyance upper roller 51 is raised and spaced apart from the stack conveyance lower roller 52 to be ready for the next sheet stack.

After pushing the sheet stack Sa between the folding rollers 57*a* and 57*b*, the pushing plate 55 moves to the pushing position again. The timing of folding the sheet between the folding rollers 57*a* and 57*b* and the timing of movement of the pushing plate 55 are set so that the pushing plate 55 is prevented from contacting both edges of the folded sheet stack Sa when the pushing plate 55 moves again to the pushing position. Therefore, even if the common motor, i.e. the stapling/folding motor 170, drives the pushing plate 55 and the folding rollers 57*a* and 57*b*, the sheet stack Sa is not damaged. Furthermore, the sheet post-processing device 2 can be made small.

In the offset mode, the paddle 17, stopper 21, conveyance lower roller 18, and conveyance upper roller 19 work in cooperation so that the edges of the sheets S discharged from the discharge roller pair 6 are successively offset in the sheet conveyance direction on the process tray 8 and first stack guide 27. The stapler unit 30 and/or folding unit 50 perform the stitching process and/or folding process at a predetermined stitching position and/or folding position.

Figure 16:
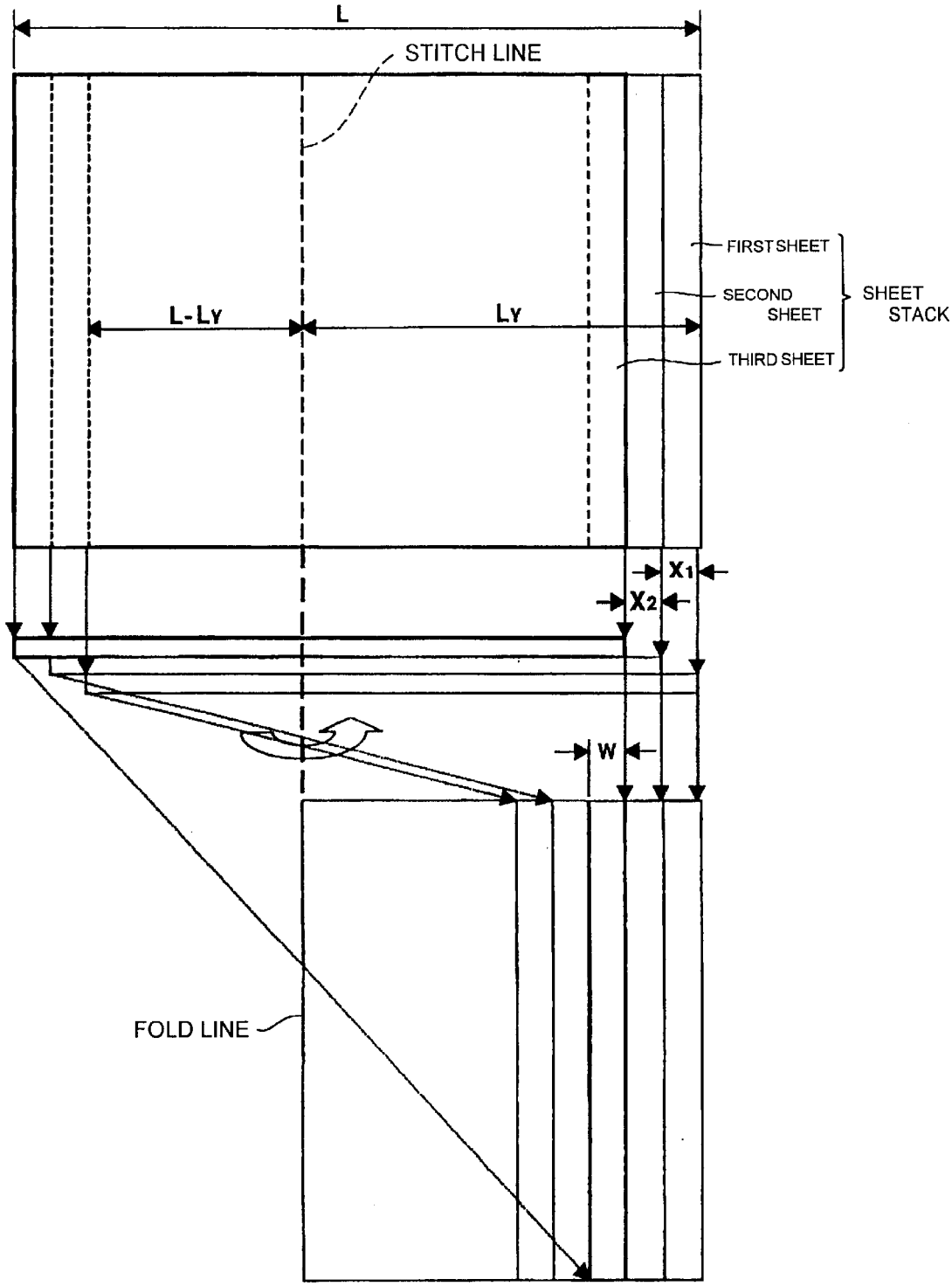
FIG. 16 is a view showing a sheet stack in an offset state, a stitching position, and a folding position.

FIG. 16 shows a sheet stack of three sheets, including the first sheet as the outermost page during the folding process, the third sheet as the innermost page during the folding process, and the second sheet as an intermediate page. A shift of the second sheet with respect to the first (outer) sheet is defined as $X_1$, a shift of the third sheet with respect to the second sheet is defined as $X_2$, and likewise a shift of a Y-th sheet with respect to a (Y−1)-th sheet is defined as $X_{Y-1}$ represent. Also, a shift between edges facing each other when the innermost Y-th sheet is folded is defined as W, and L (common size) represents the length the sheet stack. A folding position $L_Y$ from the edge of the first sheet, namely, the outermost sheet, is defined by the following equation. A stitching position $L_Y$ from the edge of the first sheet, namely, the outermost sheet, is also defined by the following equation.

$$L_Y=(L+W)/2+(X_1+X_2+\ldots+X_{Y-1})$$

In the offset mode, the edges of the sheets are successively shifted so that each edge is visible when viewed from above or below the sheet stack. In the case that the stitching process is performed, the stitching position $L_Y$ is set at a position $((L-L_Y)<L_Y)$ closer to one end of the sheet stack (the left side in FIG. 16) than to the other end of the sheet stack (the right side in FIG. 16). In the case that the folding process is performed, the edge of the innermost sheet remain visible after the completion of the folding process.

The offset modes include three modes, namely, (A) an offset saddle stitch mode in which the stitching process is performed at the stitching position $L_Y$, and the folding process is performed at the folding position $L_Y$, (B) an offset stapling mode in which the stitching process is performed at the stitching position but no folding process is performed, and (C) an offset saddle mode in which the folding process is performed at the folding position but no stitching process is performed. The operator selects one of the offset modes, and inputs values of the shifts X and W through the touch panel 147. For the sake of explanation, these modes will be explained in the case that the operator inputs a value a as default values of the shifts X and W ($X_1=X_2=\ldots=X_{Y-1}=\alpha$).

When the offset saddle stitching mode is selected, the control unit 149 activates the stapler slide motor 42 to move the head assembly 31 and anvil assembly 32 to the initial positions to be detected by the staple slide HP sensor 168. The control unit 149 turns on the solenoid 22 to move the stopper 21 to the restraining position. At that time, the conveyance upper roller 19 stays at the spaced position.

In parallel, the control unit 149 activates the conveyance motor 162 to rotate the conveyance roller pair 5 and discharge roller pair 6 to discharge the sheet S into the process tray 8 from the discharge roller pair 905 in the copying apparatus main unit 1. The conveyance roller pair 5 and discharge roller pair 6 convey the sheet S discharged from the copying apparatus main unit 1 to the process tray 8. When the sheet detector sensor 4 detects the first sheet S, the control unit 149 measures start timings of the alignment motor 14 that moves the alignment plate 9 and paddle motor 165 that rotates the paddle 17, respectively.

Figure 13:
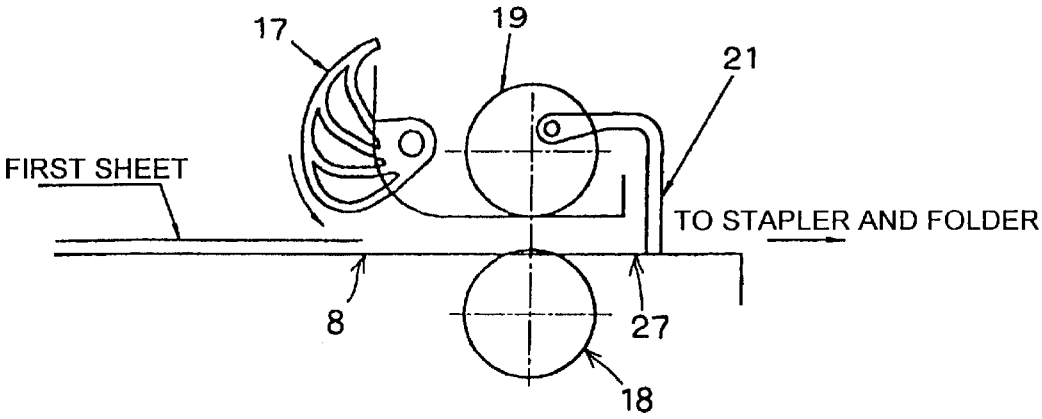
FIGS. 13(A)–13(C) are views showing an operation of an offset unit performed on the first sheet, wherein the sheet is processed from FIG. 13(A) to FIG. 13(C)

As shown in FIG. 13(A), when the sheet (of paper) S is discharged on the process tray 8, the alignment motor 14 and paddle motor 165 are activated. In response, the alignment plate 9 moves in the width direction perpendicular to the sheet conveyance direction to align both edges of the sheet S. The paddle 17 rotates around the axis 17*a* by one revolution to move the first sheet S to a position where the forward edge of the first sheet S abuts against the sidewall of the leg of the stopper 21 at the restraining position, in cooperation with the process tray 8 and first stack guide 27 tilted to assist the first sheet S to move.

Figure 13B:
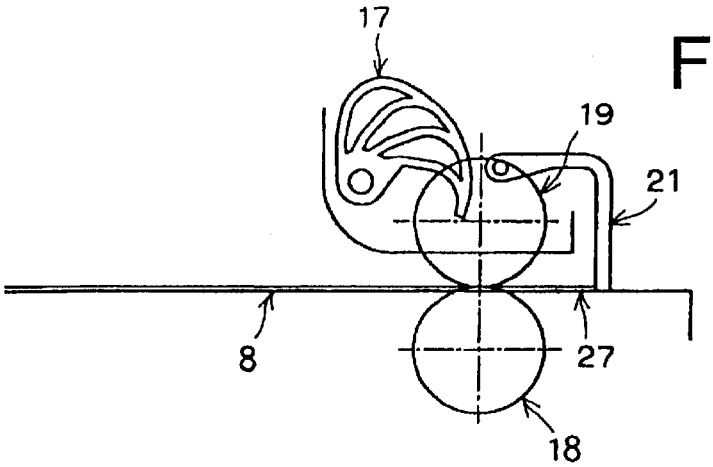
Figure 13C:
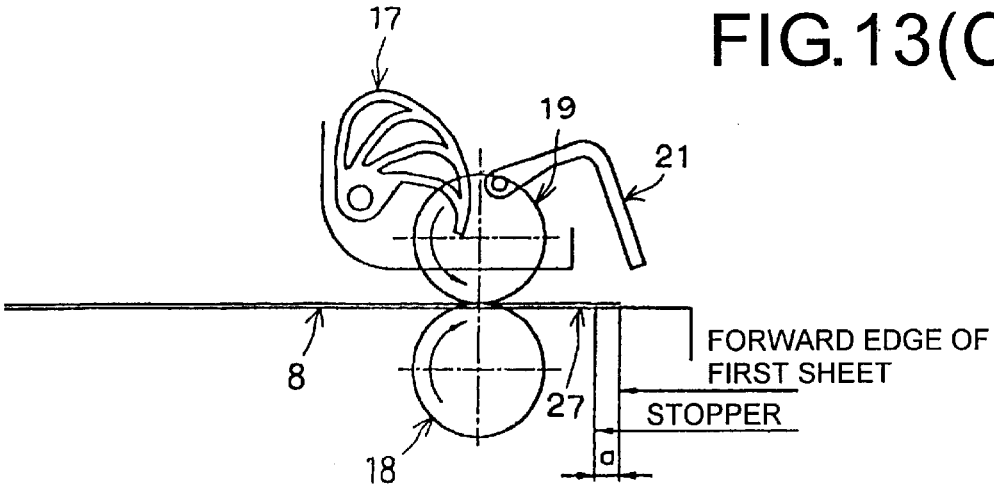

The conveyance upper roller 19 moves from the spaced position to the contact position to nip the first sheet S against the conveyance lower roller 18 (see FIG. 13(B)). Then, the stopper 21 moves to the retraction position, and the stepping motor 70 rotates. Accordingly, the first sheet S nipped between the conveyance lower roller 18 and conveyance upper roller 19 is moved toward the stapler unit 30 by a shift of $\alpha$ from the sidewall of the stopper 21 where the forward edge of the first sheet S abuts against. The stepping motor 70 stops rotating the conveyance lower roller. 18 and conveyance upper roller 19 (see FIG. 13(C)).

Figure 14A:
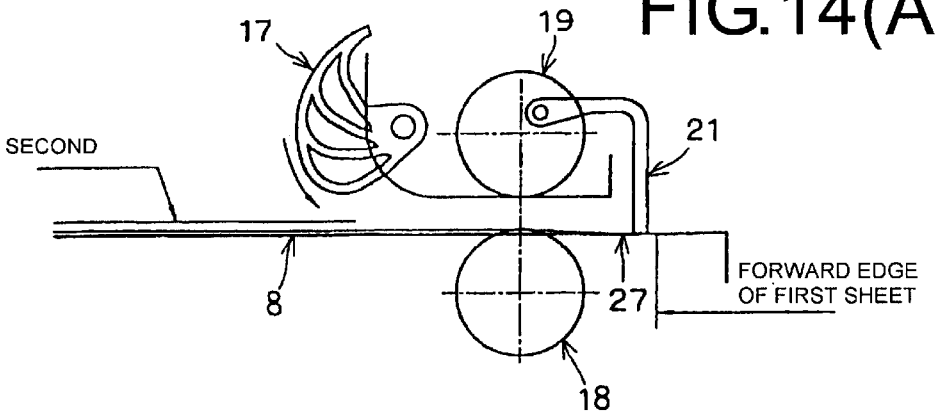
FIGS. 14(A)–14(C) are views showing an operation of the offset unit performed on the second sheet continued from the first sheet, wherein the sheets are processed from FIG. 14(A) to FIG. 14(C)

When the solenoid 22 is turned on, the conveyance upper roller 19 moves to the spaced position from the contact position after the bottom of the leg of the stopper 21 presses the forward edge of the first sheet S with the first stack guide 27 being as a receiver for the first sheet S. When the second sheet S is discharged into the process tray 8, the paddle motor 165 starts rotating (see FIG. 14(A)).

Figure 14B:
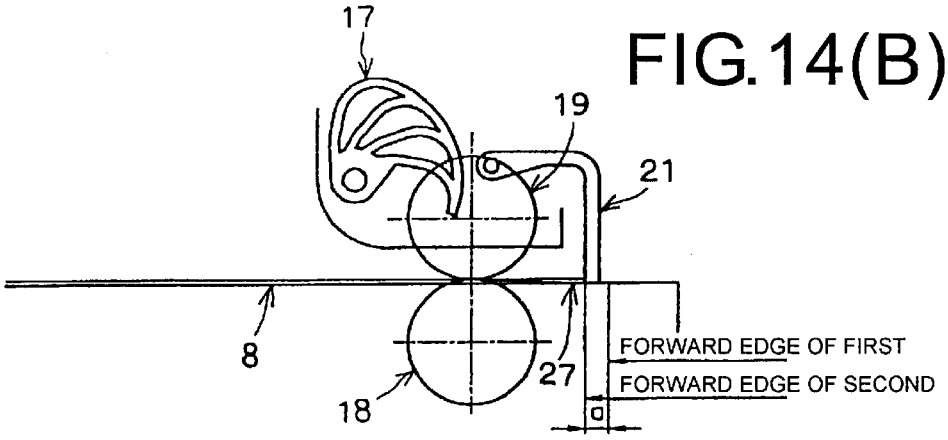

The paddle 17 rotates around the axis 17*a* by one revolution to move the second sheet S to a position where the forward edge of the second sheet S abuts against the sidewall of the leg of the stopper 21 at the restraining position. At this time, there is an offset (shift) of $\alpha$ between the forward edge of the first sheet S and the forward edge of the second sheet S. The conveyance upper roller 19 moves from the spaced position to the contact position to nip the first and second sheets S against the conveyance lower roller 18 (see FIG. 14(B)).

Figure 14C:
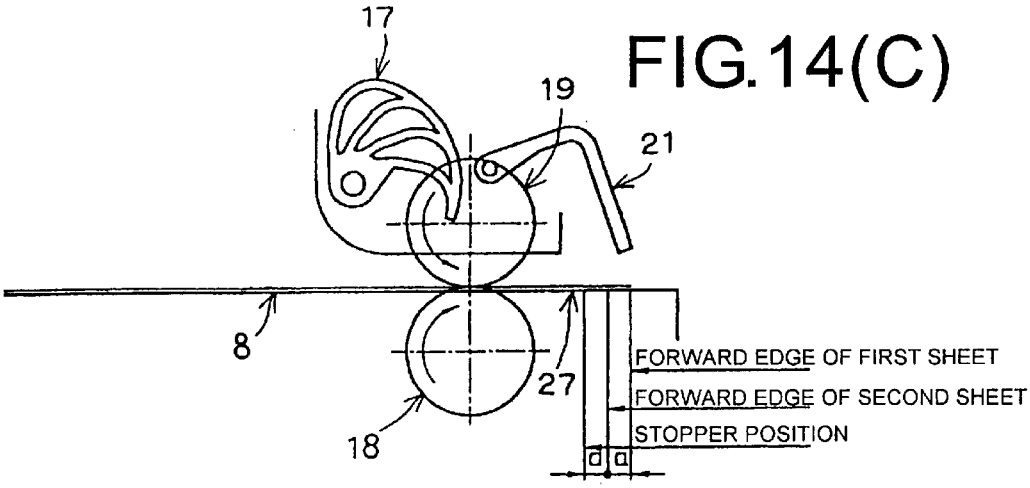

The stopper 21 moves to the retraction position. The first and second sheets S nipped between the conveyance lower roller 18 and conveyance upper roller 19 move together toward the stapler unit 30 by a shift of $\alpha$ from the sidewall of the stopper 21 where the forward edge of the second sheet S abuts against. The stepping motor 70 stops rotating the conveyance lower roller 18 and conveyance upper roller 19 (see FIG. 14(C)). In this state, there is the offset of a between the forward edge of the first sheet S and the forward edge of the second sheet S, and between the forward edge of the second sheet S and the sidewall of the leg of the stopper 21 where the forward edge of second sheet S abuts.

Figure 15A:
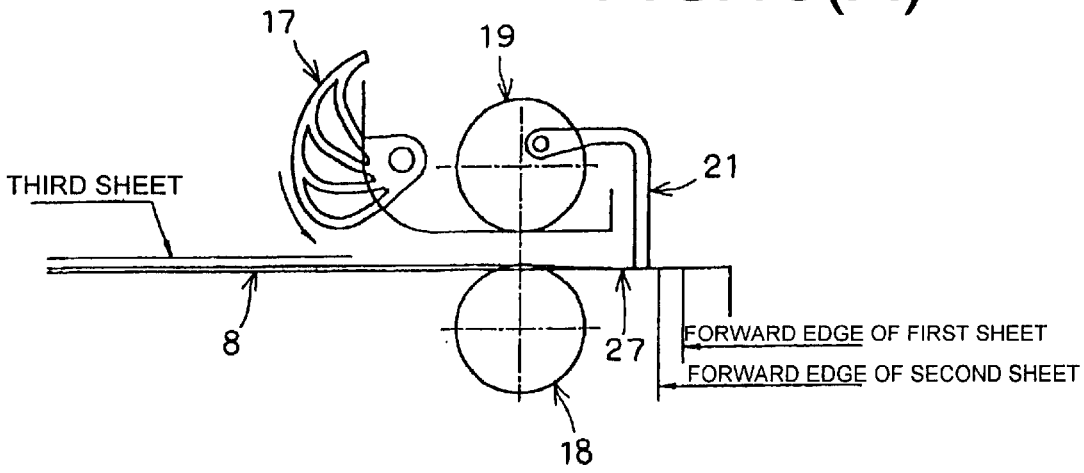
FIGS. 15(A)–15(B) are views showing an operation of the offset unit performed on the third sheet continued from the second sheet, wherein the sheets are processed from FIG. 15(A) to FIG. 15(B)

When the solenoid 22 is turned on, the conveyance upper roller 19 moves to the spaced position from the contact position after the bottom of the leg of the stopper 21 presses the forward edges of the first and second sheets S from above. When the third sheet S is discharged into the process tray 8, the paddle motor 165 starts rotating (see FIG. 15(A)).

Figure 15B:
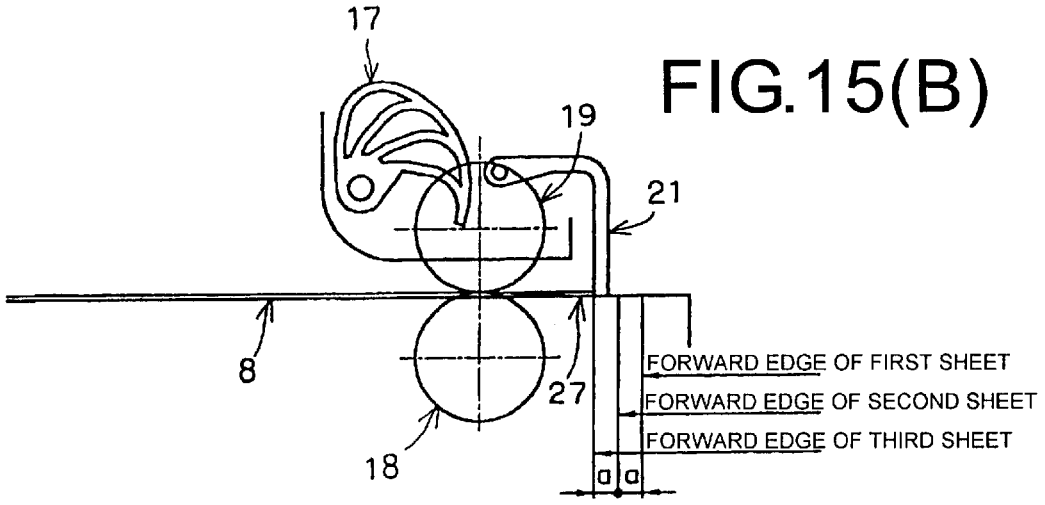

The paddle 17 rotates around the axis 17*a* by one revolution to move the third sheet S until the forward edge of the third sheet S abuts against the sidewall of the leg of the stopper 21 at the restraining position. The conveyance upper roller 19 moves from the spaced position to the contact position to nip the first, second and third sheets S against the conveyance lower roller 18 (see FIG. 15(B)). In this state, there is an offset of $\alpha$ between the forward edge of the first sheet S and the forward edge of the second sheet S, and between the forward edge of the second sheet S and the sidewall of the leg of the stopper 21 where the forward edge of third sheet S abuts. Similarly, the same offset process is repeated until the Y-th sheet S is processed in response to the input through the touch panel 147 by the operator.

Next, the stepping motor 70 rotates to move the sheet stack nipped between the conveyance upper roller 19 and conveyance lower roller 18 to the stapler unit 30. In response, the conveyance upper roller 19 and conveyance lower roller 18 convey the sheet stack to a position where the stitching position $L_Y$ is located at the head position of the head assembly 31 at the initial position while nipping the sheet stack, and then, the conveyance upper roller 19 and conveyance lower roller 18 stop. In this case, the stitching position $L_Y$ with respect to the forward edge of the first sheet is given as $(L+\alpha)/2+\{\alpha\times(Y-1)\}$ by substituting $X_1=X_2=\ldots=X_{Y-1}=W=\alpha$. The position information is then stored in the RAM as the folding position $L_Y$.

The stapling/folding motor 170 drives the head driving shaft 38 and anvil driving shaft 37 in the operational directions to perform the stitching operation. When the stitching operation is performed at several stitching positions, the stapler slide motor 42 is activated. The guide screw shafts 35 and 36 rotate to move the head assembly 31 and anvil assembly 32 to a predetermined position in a direction perpendicular to the sheet conveyance direction, and then the stitching operation is performed.

To perform the folding operation, the conveyance motor 162 rotates in the reverse direction to rotate the upper roller movement cam 68 as in the saddle stitching mode. The stack conveyance upper roller 51 is then lowered toward the stack conveyance lower roller 52 through the bearing holder 102. The sheet stack is thus nipped by the pulling spring 104. The conveyance upper roller 19 in the process tray 8 moves to the spaced position to disengage the sheet stack.

Figure 17A:
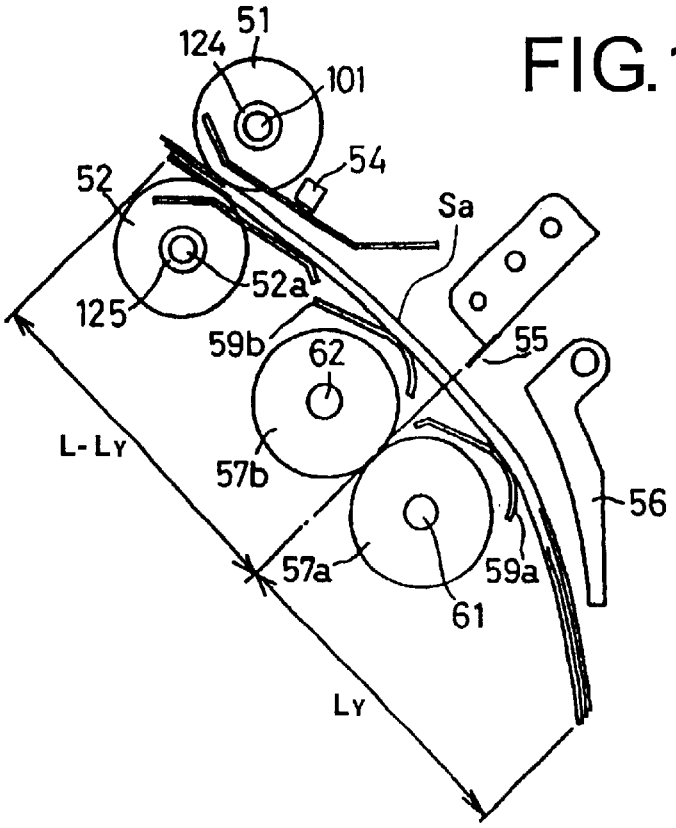

The conveyance motor 162 rotates the stack conveyance upper roller 51 and stack conveyance lower roller 52 to convey the sheet stack further in a downstream direction. During the conveyance, the control unit 149 decelerates and then stops the conveyance motor 162 in accordance with a signal detected by the edge detector sensor 54 and the information of the folding position $L_Y$ stored in the RAM so that the sheet stack is folded at the folding position $L_Y$. In this state, the forward edge of the sheet stack is suspended in the sheet stack passage 58 while nipped between the stack conveyance upper roller 51 and stack conveyance lower roller 52 (see FIG. 2 and FIG. 17(A)).

Figure 17B:
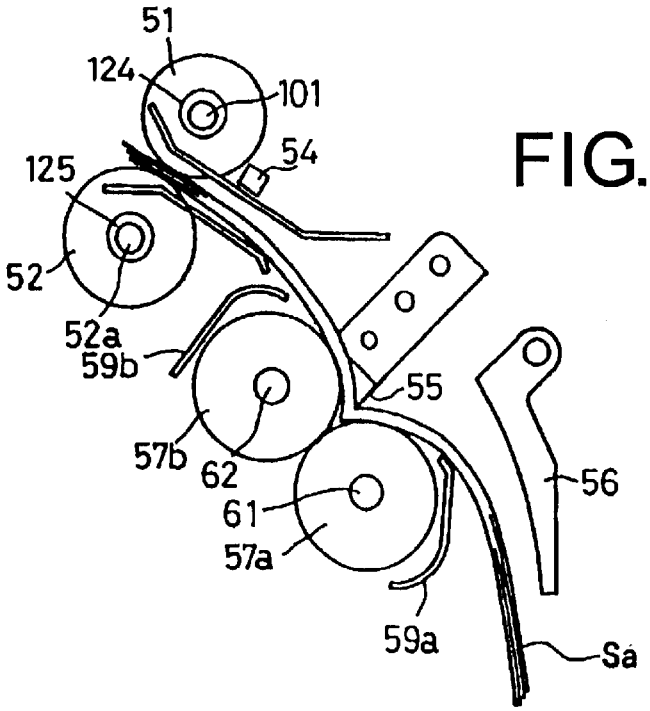
Figure 18A:
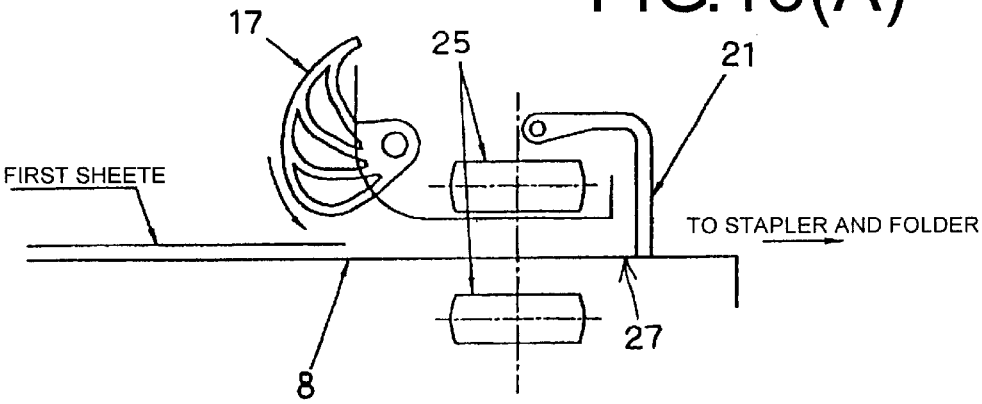
FIGS. 18(A)–18(C) are views showing an operation of an offset unit performed on the first sheet in another embodiment, wherein a sheet is processed from FIG. 18(A) to FIG. 18(C)
Figure 18B:
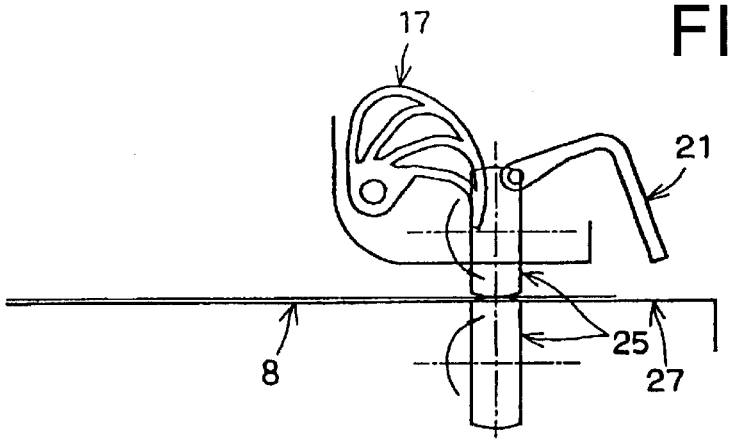
Figure 18C:
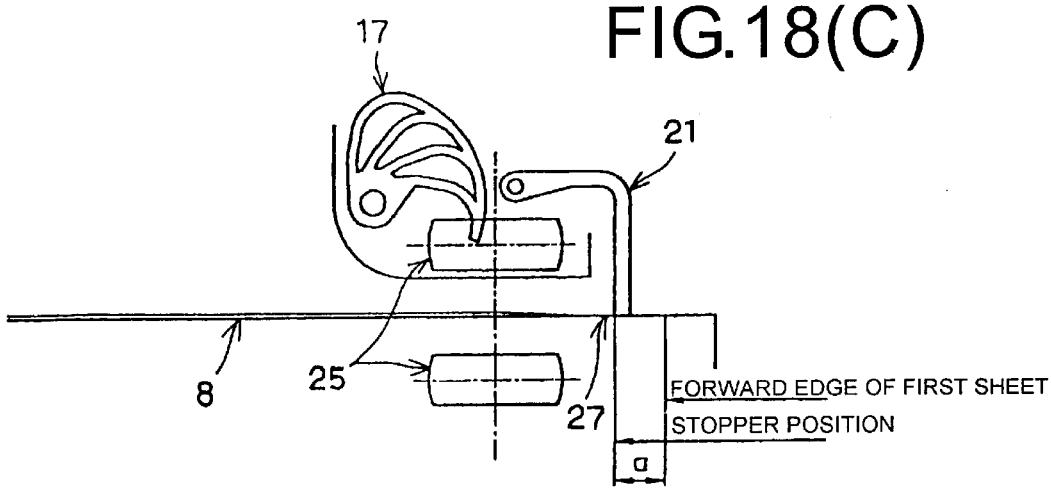
Figure 19A:
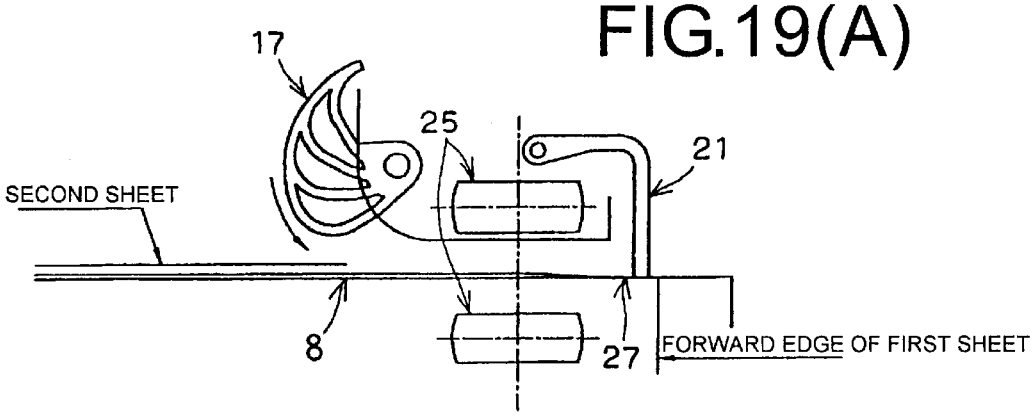
FIGS. 19(A)–19(C) are views showing an operation of the offset unit performed on the second sheet continued from the first sheet, wherein the sheets are processed from FIG. 19(A) to FIG. 19(C)
Figure 19B:
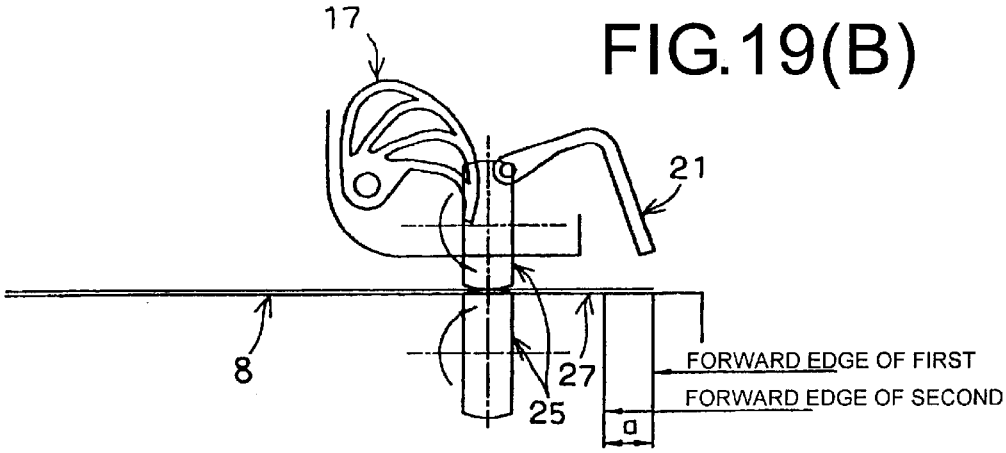
Figure 19C:
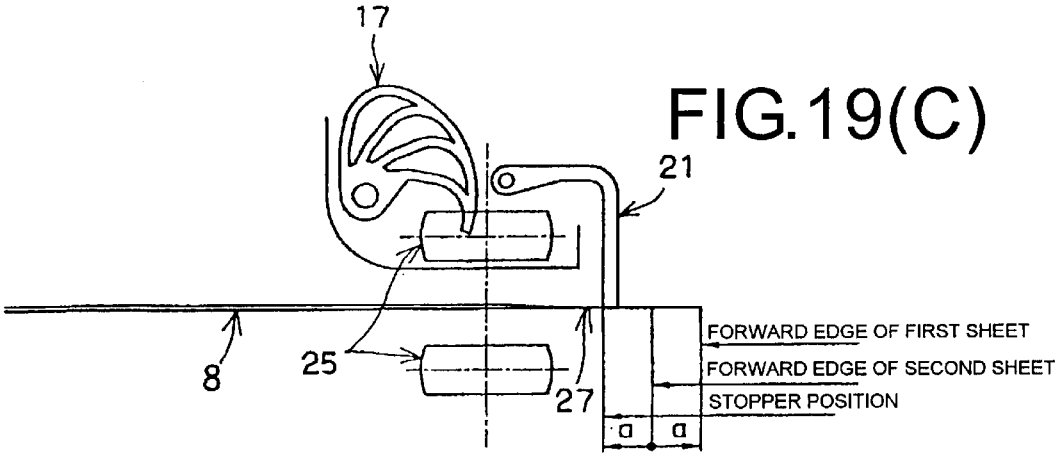
Figure 20:
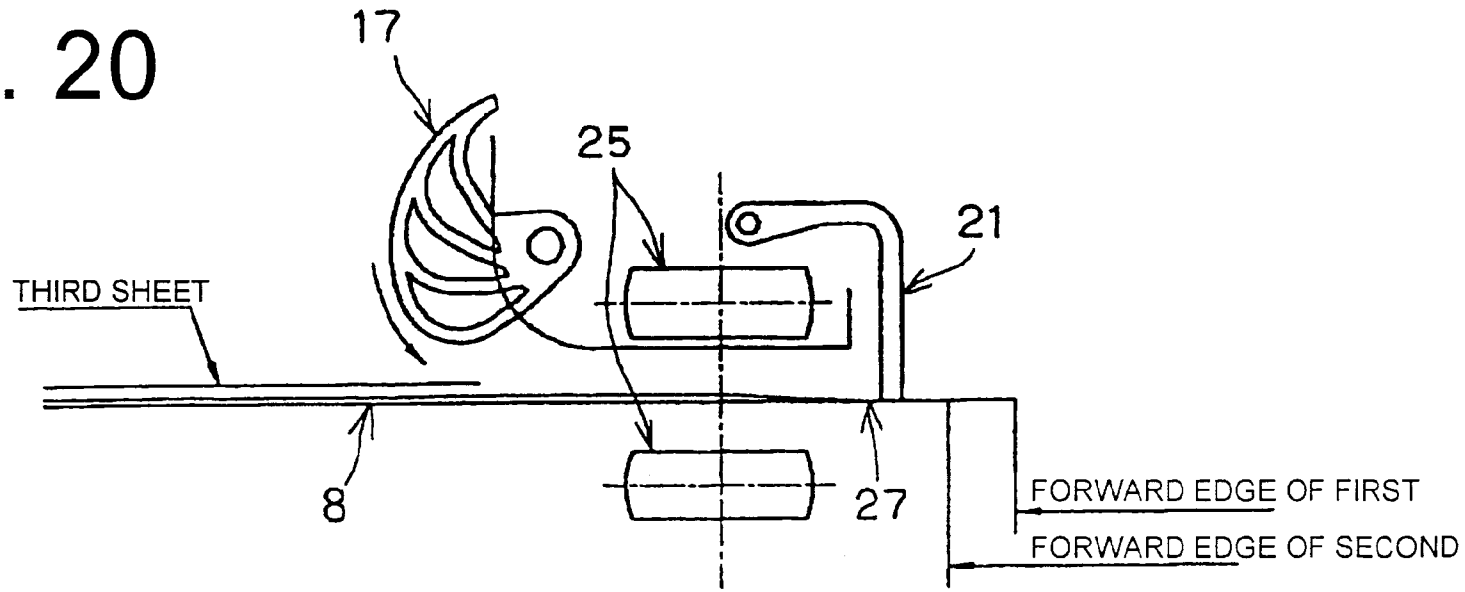
FIG. 20 is a view showing an operation of the offset unit performed on the third sheet continued from the second sheet.

The stapling/folding motor 170 rotates in a direction opposite to that for the stitching operation. As shown in FIG. 17(B), the folding rollers 57*a* and 57*b* rotate in a direction to nip the sheet stack Sa while the pushing plate 55 is lowered at the same time. In synchronization with the lowering operation of the pushing plate 55, the backup guides 59*a* and 59*b* move to expose the circumferences of the folding rollers 57*a* and 57*b* toward the sheet stack Sa. When the pushing plate 55 is lowered, the sheet stack Sa is pulled between the folding rollers 57*a* and 57*b*. The pushing plate 55 is spaced away from the sheet stack Sa, and the sheet stack Sa is further folded between the folding rollers 57*a* and 57*b*.

The sheet stack Sa conveyed in the nipped state between the folding rollers 57*a* and 57*b* is then discharged into and stocked on the folded sheet stack discharge stacker 80. With the folded sheet pressure member 81 pressing the sheet stack Sa, the folded sheet stack (the booklet) is not opened and does not interfere with the next booklet.

After the start of the folding operation, when the pushing plate HP sensor 169 detects that the pushing plate 55 moves back and forth by a predetermined number of times according to the length of the sheet stack Sa in the sheet conveyance direction, the control unit 149 stops the stapling/folding motor 170. After the sheet stack Sa is nipped between the folding rollers 57*a* and 57*b*, the stack conveyance upper roller 51 is raised and spaced apart from the stack conveyance lower roller 52 to be ready for the next sheet stack.

In the offset saddle stitching mode, after pushing the sheet stack Sa between the folding rollers 57*a* and 57*b*, the pushing plate 55 moves to the pushing position again. The timing of sheet folding between the folding rollers 57*a* and 57*b* and the timing of movement of the pushing plate 55 are set so that the pushing plate 55 is prevented from contacting both edges of the folded sheet stack Sa when the pushing plate 55 moves again to the pushing position. Therefore, even if the common driver, i.e. the stapling/folding motor 170, drives the pushing plate 55 and the folding rollers 57*a* and 57*b*, the sheet stack Sa is free from being damaged. Furthermore, the sheet post-processing device 2 can be made compact.

When the offset stapling mode is selected, the control unit 149 performs the offset process and stitching process as in the offset saddle stitching mode.

When the stitching operation is completed, the stepping motor 70 drives the conveyance lower roller 18, conveyance upper roller 19, and conveyance belt 12 toward the lifting tray 90 as in the offset saddle stitching mode (unlike the offset saddle stitching mode in which the sheet stack is folded and moved to the folding unit 50). Accordingly, the pushing nail 13 pushes and places the sheet stack on the lifting tray 90 after the stitching operation. The remaining operation of the offset stapling mode is the same as that of the non-stapling mode, thus the explanation thereof is omitted.

When the offset saddle mode is selected, the control unit 149 performs the offset process as in the offset saddle stitching mode.

When the offset process is completed, the control unit 149 activates the stepping motor 70 to convey the sheet stack nipped between the conveyance upper roller 19 and conveyance lower roller 18 toward the folding unit 50. In parallel, the conveyance motor 162 rotates in the reverse direction to rotate the upper roller movement cam 68. The stack conveyance upper roller 51 is then lowered toward the stack conveyance lower roller 52 through the bearing holder 102. The sheet stack is thus nipped by the pulling spring 104. Then, the conveyance upper roller 19 in the process tray 8 is raised from the sheet stack, thereby releasing the sheet stack.

The conveyance motor 162 is activated to rotate the stack conveyance upper roller 51 and stack conveyance lower roller 52 to convey the sheet stack further in a downstream direction. During the conveyance, the control unit 149 decelerates and then stops the conveyance motor 162 in accordance with a signal detected by the edge detector sensor 54 and information of the folding position $L_Y$ stored in the RAM so that the sheet stack is folded at the folding position $L_Y$ (see FIG. 17(A)).

The stapling/folding motor 170 rotates in a direction opposite to that for the stitching operation. As shown in FIG. 17(B), the folding rollers 57*a* and 57*b* rotate in a direction to nip the sheet stack Sa, at the same time, the pushing plate 55 is lowered. In synchronization with the lowering operation of the pushing plate 55, the backup guides 59*a* and 59*b* move to expose the circumferences of the folding rollers 57*a* and 57*b* toward the sheet stack Sa. When the pushing plate 55 is lowered, the sheet stack Sa is pulled between the folding rollers 57*a* and 57*b*. The pushing plate 55 is spaced away from the sheet stack Sa, and the sheet stack Sa is further folded between the folding rollers 57*a* and 57*b*.

The sheet stack Sa conveyed in the nipped state between the folding rollers 57*a* and 57*b* is then discharged into and stocked on the folded sheet stack discharge stacker 80. With the folded sheet pressure member 81 pressing the sheet stack Sa, the folded sheet stack without the stitching is not opened and does not interfere with the next booklet.

After the start of the folding operation, when the pushing plate HP sensor 169 detects that the pushing plate 55 moves back and forth by a predetermined number of times according to the length of the sheet stack Sa in the sheet conveyance direction, the control unit 149 stops the stapling/folding motor 170. After the sheet stack Sa is nipped between the folding rollers 57*a* and 57*b*, the stack conveyance upper roller 51 is raised and spaced apart from the stack conveyance lower roller 52 to be ready for the next sheet stack.

Hereunder, advantages of the copying apparatus 1A of the embodiment of the present invention will be explained.

The copying apparatus 1A of the present invention includes the copying apparatus main unit 1 and the sheet post-processing device 2 detachably mounted on the copying apparatus main unit 1. The sheet post-processing device 2 includes the conveyance unit 100, offset unit 20, stapler unit 30, folding unit 50, etc., so that the sheet S is post-processed in a variety of modes. In particular, the edges of the sheets S are shifted as shown in FIG. 16 in the offset saddle stitching mode, thereby making it easy to turn the pages.

The sheet stack is stitched but not folded in the offset stapling mode. If a number of sheet stacks storing sheets bearing identical images are placed, the overall thickness is small. The sheet stacks are easy to transport, and after being transported, the sheet stacks may be folded at the stitching position LY. Resulting booklets are easy to page turn.

In the offset saddle mode, the sheet stack is folded but not stitched. Thus, when the image recorded on the sheet needs to be corrected, a new sheet can be folded manually and inserted. The sheet stack is then manually stapled at the folding position $L_Y$, thereby obtaining the booklet easy to turn the pages.

The copying apparatus 1A of the present invention can perform the offset process, thereby obtaining the booklet easy to turn the pages even for a person with large fingers, a person using a single hand, and a person with a crippled hand. The copying apparatus having such a function has a significant industrial value from the standpoint of helping handicapped and senior people to participate in corporate and social activities.

As shown in FIG. 13(A) through FIG. 15(B), the edge of the sheet S is offset one by one in the process of forming the sheet stack. The sheets S are thus reliably and precisely offset without being influenced by a difference in friction between the sheets S. Alternatively, the edges of all sheets of the sheet stack may be restrained and aligned by the stopper, and the edges of the sheets are then shifted using a cylinder for offsetting the edges. In this mechanism, however, it is difficult to offset the sheets S uniformly because of the difference in friction between the sheets, thereby being inferior to the offset mechanism of the present invention.

In the sheet post-processing device 2 of the invention, all the sheets on the process tray 8 and first stack guide 27 are held with the stopper 21 at the restraining position when the paddle 17 urges the second and subsequent sheets S toward the stopper 21. At that time, the conveyance upper roller 19 remains at the spaced position to allow the paddle 17 to urge the sheets S toward the stopper 21. Therefore, if all the sheets on the process tray 8 and first stack guide 27 remains in a non-held state, the offset posture of all the sheets will be destroyed. Since the stopper 21 holds all the sheets on the process tray 8 and first stack guide 27, the posture of the offset sheets is maintained, thereby preventing the destruction of the offset posture of the sheet stack and booklet.

In the offset process of the embodiments, the conveyance lower roller 18 and conveyance upper roller 19 have the function of conveying the sheet stack toward the stapler unit 30, as well as the function of offsetting the sheet stack by a shift of $\alpha$. Further, the stopper 21 has the function of pressing the sheet stack from above with the bottom thereof, as well as the function of restraining the sheets S with the sidewall of the stopper 21, thereby reducing the number of the parts in the offset unit 20. Therefore, it is possible to make the offset unit 20 and the sheet post-processing device 2 small.

In the embodiments, the copying apparatus 1A includes the copying apparatus main unit 1 with the sheet post-processing device 2 attached thereto. The invention is also applicable to a sheet post-processing device commercially available as a separate unit to achieve the same advantages, when the sheet post-processing device is provided with an interface for sending a control signal such as of sheet size information from a control unit of a copying apparatus to a control unit of the sheet post-processing device.

In the embodiments, the operator inputs the value of the shift using the touch panel 147 of the sheet post-processing device 2. Alternatively, the operator may input the value of the shift using an operation unit (not shown) of the copying apparatus main unit 1. In this case, the ROM of the control unit 950 in the copying apparatus main unit 1 may store the same program and data as those of the control unit 149 in the sheet post-processing device 2. Alternatively, a portion of the program and data may be sent to the control unit 950 through an interface after turning on the control unit 149.

For the sake of the explanation, the operator inputs the default shift value $\alpha$ through the touch panel 147, and the control unit 149 calculates the folding position $L_Y$ and the stitching position $L_Y$. It is possible to create a table based on a plurality of the shifts and the folding positions $L_Y$ and/or the stitching position $L_Y$ in advance. According to a selected shift (distance of travel), the folding position $L_Y$ and/or the stitching position $L_Y$ may be read from the table. The shift is thus easily set or modified by storing such a table in a memory.

In the embodiments, the sheet post-processing device 2 includes both the stapler unit 30 and folding unit 50. It is also possible to obtain the booklet when the sheet post-processing device 2 includes at least one of the stapler unit 30 and folding unit 50. Without one of the stapler unit 30 and folding unit 50, the sheet post-processing device 2 becomes compact and less expensive.

In the embodiments, the sheets S are offset in the sheet conveyance direction on the process tray 8 and first stack guide 27. Alternatively, the sheets S may be offset in a direction perpendicular to the sheet conveyance direction. It is also perfectly acceptable if the sheets S are offset in both the sheet conveyance direction and the direction perpendicular to the sheet conveyance direction, thereby making it easy to turn the pages of such a booklet.

Further, in the embodiments described above, the first stack guide 27 and process tray 8 are two separate parts. Alternatively, the process tray 8 may extend to one side (toward the stapler unit 30) by a length corresponding to the first stack guide 27.

In the above embodiments, the conveyance lower roller 18 and conveyance upper roller 19 are formed in a tire shape, and nip the sheet stack during the offset process. Alternatively, as shown in FIG. 18(A) through FIG. 20, the same advantages are obtained in the same operation when the rotary members 25 having an arc cross section and longitudinal ends engaging with each other are used. The use of the rotary members 25 eliminates the cam mechanism for placing the conveyance upper roller 19 at the contact position and spaced position. The offset process is thus performed quickly. The states shown in FIG. 18(A) through FIG. 20 correspond to the states shown in FIG. 13(A) through FIG. 15(A), respectively.

As described above, according to the first, fourth and seventh aspects of the present invention, it is easy to turn the pages of the folded sheet stack. According to the second, fifth and eighth aspects of the present invention, it is easy to turn the pages of the stitched and folded sheet stack. Further, according to the third, sixth and ninth aspects of the present invention, it is easy to turn the pages of the booklet.

While the invention has been explained with reference to the specific embodiments of the invention, the explanation is illustrative and the invention is limited only by the appended claims.

What is claimed is:

1. A sheet post-processing device comprising:

placement means for placing sheets discharged from an image forming apparatus, offset means disposed adjacent to the placement means for offsetting first side edges of the sheets on the placement means, and post processing means including at least one of folding means for folding a stack of the sheets with the edges thereof offset by the offset means and saddle stitching means for saddle stitching the stack of the sheets with the edges thereof being offset by the offset means.

2. A sheet post-processing device according to claim 1, wherein when the folding means and said saddle stitching means are actuated, after the saddle stitching means is actuated, the folding means is actuated for folding a predetermined position of the stack of the sheets saddle stitched by the saddle stitching means.

3. A sheet post-processing device according to claim 2, wherein said offset means offsets the first side edges of the sheets on the placement means so that the first side edges of the sheets are visible from above or below the stack of the sheets.

4. A sheet post-processing device according to claim 2, wherein said saddle stitching means stitches the stack of the sheets at positions closer to second side edges of the sheets than said first side edges of the sheets, said second side edges being located opposite to the first side edges.

5. A sheet post-processing device according to claim 2, wherein said folding means folds the stack of the sheets so that an edge of an innermost sheet in the stack of the sheets remains visible after the stack of the sheets is folded.

6. A sheet post-processing device according to claim 2, wherein said folding means folds the stack of the sheets along a line where the sheets are stitched.

7. A sheet post-processing device comprising:

placement means for placing sheets discharged from an image forming apparatus, restraining means situated adjacent to the placement means to be movable between a restraining position at which the restraining means restrains and aligns edges of the sheets discharged into the placement means and a retraction position to which the restraining means is retracted from the restraining position, urging means disposed adjacent to the placement means for urging the sheets discharged into the placement means toward the restraining means, sheet moving means situated adjacent to the placement means to be movable between a first position at which the sheet moving means nips the sheets on the placement means to move the sheets for a predetermined distance and a second position at which the sheet moving means is located away from the sheets on the placement means to allow the urging means to urge the sheets, post processing means including at least one of folding means for folding the sheets and saddle stitching means for stitching the sheets, and control means for controlling the restraining means, the urging means, and the sheet moving means to repeat steps in which the restraining means moves from the restraining position to the retraction position, the sheet moving means moves a first sheet on the placement means for the predetermined distance, the restraining means moves from the retraction position to the restraining position, the sheet moving means moves to the second position, and the urging means urges a next sheet toward the restraining means for alignment, until a stack of the sheets is formed on the placement means with edges of the sheets being successively offset, said control means controlling the post processing means for performing post processing to the stack of the sheets.

8. A sheet post-processing device according to claim 7, wherein when the saddle stitching means and the folding means are actuated, after operating the saddle stitching means to stitch the stack of the sheets, the folding means is actuated to fold the stack of the sheets at a predetermined position.

9. A sheet post-processing device according to claim 8, wherein said control means controls the restraining means to hold the sheets on the placement means at the restraining position when the urging means urges the next sheet toward the restraining means.

10. A sheet post-processing device according to claim 8, further comprising setting means for setting the predetermined distance moved by the sheet moving means, said control means controlling the sheet moving means according to the predetermined distance set by the setting means.

11. An image forming apparatus comprising:

storage means for storing sheets, sheet feeder means for feeding the sheets from the storage means one by one, image forming means for forming an image on the sheets fed by the sheet feeder means, placement means for placing the sheets with the image formed thereon discharged from the image forming means, restraining means disposed adjacent to the placement means to be movable between a restraining position at which the restraining means restrains and aligns edges of the sheets discharged into the placement means and a retraction position to which the restraining means is retracted from the restraining position, urging means disposed adjacent to the placement means for urging the sheets discharged into the placement means toward the restraining means, sheet moving means situated adjacent to the placement means to be movable between a first position at which the sheet moving means nips the sheets on the placement means and moves the sheets by a predetermined distance and a second position at which the sheet moving means is located away from the sheets on the placement means and allows the urging means to urge the sheets, post processing means including at least one of folding means for folding the sheets and saddle stitching means for stitching the sheets, and control means for controlling the restraining means, the urging means, and the sheet moving means to repeat steps in which the restraining means moves from the restraining position to the retraction position, the sheet moving means moves a first sheet on the placement means for the predetermined distance, the restraining means moves from the retraction position to the restraining position, the sheet moving means moves to the second position, and the urging means urges a next sheet toward the restraining means for alignment, until a stack of the sheets is formed on the placement means with edges of the sheets being successively offset, said control means controlling the post processing means for performing post processing to the stack of the sheets.

12. An image forming apparatus according to claim 11, wherein when the saddle stitching means and the folding means are actuated, after operating the saddle stitching means to stitch the stack of the sheets, the folding means is actuated to fold the stack of the sheets at a predetermined position.

13. A sheet post-processing device according to claim 12, wherein said control means controls the restraining means to hold the sheets on the placement means at the restraining position when the urging means urges the next sheet toward the restraining means.

14. A sheet post-processing device according to claim 12, further comprising setting means for setting the predetermined distance moved by the sheet moving means, said control means controlling the sheet moving means according to the predetermined distance set by the setting means.

* * * * *